US011271327B2

(12) United States Patent
Shan et al.

(10) Patent No.: US 11,271,327 B2
(45) Date of Patent: Mar. 8, 2022

(54) CLOAKING ANTENNA ELEMENTS AND RELATED MULTI-BAND ANTENNAS

(71) Applicant: CommScope Technologies LLC, Hickory, NC (US)

(72) Inventors: Long Shan, Suzhou (CN); Jinchun He, Suzhou (CN); YueMin Li, Suzhou (CN); Yunzhe Li, Suzhou (CN); Martin L. Zimmerman, Chicago, IL (US)

(73) Assignee: CommScope Technologies LLC, Hickory, NC (US)

( * ) Notice: Subject to any disclaimer, the term of this patent is extended or adjusted under 35 U.S.C. 154(b) by 177 days.

(21) Appl. No.: 16/609,356

(22) PCT Filed: Jun. 11, 2018

(86) PCT No.: PCT/US2018/036820
§ 371 (c)(1),
(2) Date: Oct. 29, 2019

(87) PCT Pub. No.: WO2018/231670
PCT Pub. Date: Dec. 20, 2018

(65) Prior Publication Data

US 2020/0076079 A1 Mar. 5, 2020

(30) Foreign Application Priority Data

Jun. 15, 2017 (CN) ..... 201710451502.X

(51) Int. Cl.
*H01Q 21/24* (2006.01)
*H01Q 5/48* (2015.01)
(Continued)

(52) U.S. Cl.
CPC ..... *H01Q 21/24* (2013.01); *H01Q 1/246* (2013.01); *H01Q 1/521* (2013.01); *H01Q 5/321* (2015.01);
(Continued)

(58) Field of Classification Search
CPC ..... H01Q 1/246; H01Q 1/38; H01Q 1/521; H01Q 5/321; H01Q 5/48; H01Q 9/065;
(Continued)

(56) References Cited

U.S. PATENT DOCUMENTS 6,198,442 B1 3/2001 Rutkowski et al.
6,295,028 B1 9/2001 Jonsson et al.
(Continued)

FOREIGN PATENT DOCUMENTS

CN 201576744 9/2010
CN 101916910 12/2010
(Continued)

OTHER PUBLICATIONS

Butler et al. "Broadband multiband phased array antennas for cellular communications" 2016 International Symposium on Antennas and Propagation (ISAP) (pp. 160-161) (Oct. 24, 2016).
(Continued)

*Primary Examiner* — Robert Karacsony
(74) *Attorney, Agent, or Firm* — Myers Bigel, P.A.

(57) ABSTRACT

A dipole antenna includes a planar reflector and a radiating element. The radiating element includes first and second pairs of dipoles on a surface of the planar reflector. The first and second pairs of dipoles respectively include arm segments arranged around a central region in a box dipole arrangement. The arm segments may be printed circuit board portions having respective metal segments and respective inductor-capacitor circuits thereon. The inductor-capacitor circuits define a filter aligned to a frequency range higher
(Continued)

than an operating frequency range of the first and second pairs of dipoles.

24 Claims, 17 Drawing Sheets

(51) Int. Cl.

| | |
|---|---|
| ***H01Q 9/16*** | (2006.01) |
| ***H01Q 15/14*** | (2006.01) |
| ***H01Q 1/24*** | (2006.01) |
| ***H01Q 5/321*** | (2015.01) |
| ***H01Q 1/52*** | (2006.01) |
| ***H01Q 9/06*** | (2006.01) |
| ***H01Q 19/10*** | (2006.01) |
| ***H01Q 21/28*** | (2006.01) |
| ***H01Q 21/06*** | (2006.01) |

(52) U.S. Cl.
CPC ..... *H01Q 5/48* (2015.01); *H01Q 9/065* (2013.01); *H01Q 9/16* (2013.01); *H01Q 15/14* (2013.01); *H01Q 19/108* (2013.01); *H01Q 21/062* (2013.01); *H01Q 21/28* (2013.01)

(58) Field of Classification Search
CPC ..... H01Q 9/16; H01Q 15/14; H01Q 19/108; H01Q 21/062; H01Q 21/24; H01Q 21/26; H01Q 21/28
See application file for complete search history.

(56) References Cited

U.S. PATENT DOCUMENTS

| | | | | |
|---|---|---|---|---|
| 6,313,809 | B1 | 11/2001 | Gabriel et al. | |
| 6,333,720 | B1 | 12/2001 | Goettl et al. | |
| 6,339,407 | B1 | 1/2002 | Gabriel et al. | |
| 7,053,852 | B2 | 5/2006 | Timofeev et al. | |
| 7,283,101 | B2 | 10/2007 | Bisiules et al. | |
| 7,405,710 | B2 | 7/2008 | Bisiules et al. | |
| 7,688,271 | B2 | 3/2010 | Cao et al. | |
| 9,276,329 | B2 | 3/2016 | Jones et al. | |
| 9,570,804 | B2 | 2/2017 | Shang et al. | |
| 9,711,871 | B2 | 7/2017 | Jones | |
| 9,819,084 | B2 | 11/2017 | Zimmerman et al. | |
| 2007/0229385 | A1 | 10/2007 | Deng et al. | |
| 2013/0187822 | A1* | 7/2013 | Shi | H01Q 9/16 343/821 |
| 2013/0307742 | A1 | 11/2013 | Hu et al. | |
| 2013/0335280 | A1 | 12/2013 | Chen, III et al. | |
| 2014/0028516 | A1 | 1/2014 | Semonov et al. | |
| 2014/0198002 | A1 | 7/2014 | Hunt | |

FOREIGN PATENT DOCUMENTS

| | | | |
|---|---|---|---|
| CN | 103840254 | | 6/2014 |
| CN | 204103048 | U | 1/2015 |
| CN | 105281031 | A | 1/2016 |
| CN | 105514613 | | 4/2016 |
| CN | 105684217 | | 6/2016 |
| CN | 106104914 | | 11/2016 |
| CN | 106129596 | A | 11/2016 |
| EP | 2755279 | | 7/2014 |
| WO | 2016081036 | A1 | 5/2016 |

OTHER PUBLICATIONS

Extended European Search Report Corresponding to European Application No. 18817956.8 (10 pages) (dated Feb. 11, 2021).
Gabriel et al. "Antenna Systems for Cellular Base Stations" in "Handbook of Antenna Technologies" (pp. 2271-2346) (Sep. 16, 2016).
Notification of Transmittal of the International Search Report and the Written Opinion of the International Searching Authority, or the Declaration, in corresponding PCT Application No. PCT/US2018/036820 (dated Dec. 6, 2018).
Chinese Office Action Corresponding to Japanese Patent Application No. 201710451502.X (Foreign Text, 10 Pages, English Translation Thereof, 11 Pages) (dated May 29, 2020).
Chinese Office Action Corresponding to Chinese Patent Application No. 201710451502.X (Foreign Text, 10 Pages, English Translation Thereof, 9 Pages) (dated May 26, 2021).

* cited by examiner

CLOAKING ANTENNA ELEMENTS AND RELATED MULTI-BAND ANTENNAS

CLAIM OF PRIORITY

The present application is a 35 U.S.C. § 371 national stage application of PCT Application No. PCT/US2018/036820, filed on Jun. 11, 2018, which itself claims priority under 35 U.S.C. § 119 to Chinese Patent Application No. 201710451502.X entitled "CLOAKING ANTENNA ELEMENTS AND RELATED MULTI-BAND ANTENNAS," filed with the Chinese State Intellectual Property Office on Jun. 15, 2017, the entire contents of both of which are incorporated by reference herein as if set forth in their entireties. The above-referenced PCT Application was published in the English language as International Publication No. WO 2018/231670 A2 on Dec. 20, 2018.

FIELD

The present disclosure generally relates to communications systems and, more particularly, to array antennas utilized in communications systems.

BACKGROUND

Antennas for wireless voice and/or data communications typically include an array of radiating elements connected by one or more feed networks. Multi-band antennas can include multiple arrays of radiating elements with different operating frequencies. For example, common frequency bands for GSM services include GSM900 and GSM1800. A low-band of frequencies in a multi-band antenna may include a GSM900 band, which operates at 880-960 MHz. The low-band may also include Digital Dividend spectrum, which operates at 790-862 MHz. Further, the low-band may also cover the 700 MHz spectrum at 694-793 MHz. A high-band of a multi-band antenna may include a GSM1800 band, which operates in the frequency range of 1710-1880 MHz. A high-band may also include, for example, the UMTS band, which operates at 1920-2170 MHz. Additional bands included in the high-band may include LTE2.6, which operates at 2.5-2.7 GHz and WiMax, which operates at 3.4-3.8 GHz.

For efficient transmission and reception of Radio Frequency (RF) signals, the dimensions of radiating elements are typically matched to the wavelength of the intended band of operation. A dipole antenna may be employed as a radiating element, and may be designed such that its first resonant frequency is in the desired frequency band. To achieve this, each of the dipole arms may be about one quarter wavelength, and the two dipole arms together may be about one half the wavelength of the center frequency of the desired frequency band. These are referred to as "half-wave" dipoles, and may have relatively low impedance.

Dual-band antennas have been developed which include different radiating elements having dimensions specific to each of the two bands, e.g., respective radiating elements dimensioned for operation over a low band of 698-960 MHz and a high band of 1710-2700 MHz. See, for example, U.S. Pat. Nos. 6,295,028, 6,333,720, 7,283,101 and 7,405,710, the disclosures of which are incorporated by reference. Because the wavelength of the GSM 900 band (e.g., 880-960 MHz) is longer than the wavelength of the GSM 1800 band (e.g., 1710-1880 MHz), the radiating elements dimensioned or otherwise designed for one band are typically not used for the other band.

However, multi-band antennas may involve implementation difficulties, for example, due to interference among the radiating elements for the different bands. In particular, the radiation patterns for a lower frequency band can be distorted by resonances that develop in radiating elements that are designed to radiate at a higher frequency band, typically 2 to 3 times higher in frequency. For example, the GSM1800 band is approximately twice the frequency of the GSM900 band. As such, the introduction of additional radiating elements having an operating frequency range different from the existing radiating elements in the antenna may cause distortion with the existing radiating elements.

Examples of such distortion include Common Mode resonance and Differential Mode resonance. Common Mode (CM) resonance can occur when the entire higher band radiating structure resonates as if it were a one quarter wave monopole. Since the stalk or vertical structure of the radiating element is often one quarter wavelength long at the higher band frequency and the dipole arms are also one quarter wavelength long at the higher band frequency, this total structure may be roughly one half wavelength long at the higher band frequency. Where the higher band is about double the frequency of the lower band, because wavelength is inversely proportional to frequency, the total high-band structure may be roughly one quarter wavelength long at a lower band frequency. Differential mode resonance may occur when each half of the dipole structure, or two halves of orthogonally-polarized higher frequency radiating elements, resonate against one another.

SUMMARY

According to some embodiments of the present disclosure, a dipole antenna includes a planar reflector, and a radiating element including first and second pairs of dipoles on a surface of the planar reflector. The first and second pairs of dipoles respectively include arm segments arranged around a central region in a box dipole arrangement. The arm segments may be printed circuit board portions having respective metal segments and respective inductor-capacitor circuits thereon. The inductor-capacitor circuits define a filter aligned to a frequency range higher than an operating frequency range of the first and second pairs of dipoles.

In some embodiments, the arm segments may be printed circuit board portions having the respective metal segments and the respective inductor-capacitor circuits thereon.

In some embodiments, the first and second dipoles may define a low-band radiating element. A high-band dipole antenna may be arranged within a perimeter defined by the arm segments of the low-band dipole antenna. The high-band dipole antenna may have an operating frequency range that comprises the frequency range of the filter.

In some embodiments, the arm segments of the first pair of dipoles may be capacitively coupled to the arm segments of the second pair of dipoles adjacent thereto by respective coupling regions therebetween.

In some embodiments, the respective coupling regions may be defined by overlapping portions of the respective metal segments on opposite sides of the printed circuit board portions.

In some embodiments, the respective coupling regions may be defined by portions of the respective metal segments that extend toward the planar reflector at edges of adjacent ones of the arm segments.

In some embodiments, the respective coupling regions may be defined by plated through-hole vias.

In some embodiments, the respective coupling regions may be defined by portions of the respective metal segments comprising interdigitated fingers at edges of adjacent ones of the arm segments.

In some embodiments, the arm segments of the first and second pairs of dipoles may collectively define an octagonal shape in plan view.

In some embodiments, the arm segments of the first and second pairs of dipoles may be substantially linear such that the arm segments collectively define a rectangular shape in plan view.

In some embodiments, the arm segments of the first and second pairs of dipoles may be bent at respective angles such that the arm segments collectively define a diamond shape in plan view.

In some embodiments, the arm segments of the first and second pairs of dipoles may define respective arc shapes such that the arm segments collectively define an elliptical shape in plan view.

In some embodiments, first and second pairs of feed stalks may extend from the planar reflector towards the first and second pairs of dipoles, respectively. The printed circuit board portions of the first and second pairs of dipoles may include comprise respective slots therein that are adapted to mate with respective tabs of the first and second pairs of feed stalks, respectively.

In some embodiments, the first and second pairs of feed stalks may respectively include a support printed circuit board extending from the planar reflector to support one of the arm segments of a respective one of the first and second pairs of dipoles; a feed line which extends on the support printed circuit board from the planar reflector towards the respective one of the first and second pairs of dipoles; and a balun which extends on the support printed circuit board and is connected to the feed line at an end thereof proximate the respective one of the first and second pairs of dipoles.

According to some embodiments of the present disclosure, a dipole antenna includes a planar reflector and a radiating element. The radiating element includes first and second pairs of dipoles on a surface of the planar reflector, the first and second pairs of dipoles respectively comprising arm segments arranged around a central region in a box dipole arrangement. The arm segments comprise printed circuit board portions having respective metal segments and respective inductor-capacitor circuits thereon.

According to some embodiments of the present disclosure, a multi-band antenna includes a planar reflector, a first radiating element, and a second radiating element. The first radiating element has a first operating frequency range, and includes first and second pairs of dipoles on a surface of the planar reflector. The first and second pairs of dipoles respectively include arm segments arranged around a central region in a box dipole arrangement. The arm segments may be printed circuit board portions having respective metal segments and respective inductor-capacitor circuits thereon, where the inductor-capacitor circuits define a filter aligned to a frequency range. The second radiating element is arranged on the surface of the planar reflector within a perimeter defined by the arm segments of the first radiating element. The second radiating elements have a second operating frequency range that is higher than the first operating frequency range and includes the frequency range of the filter.

In some embodiments, the arm segments may be printed circuit board portions having the respective metal segments and the respective inductor-capacitor circuits thereon.

In some embodiments, the arm segments of the first pair of dipoles may be capacitively coupled to the arm segments of the second pair of dipoles adjacent thereto by respective coupling regions therebetween.

In some embodiments, the respective coupling regions may be defined by overlapping portions of the respective metal segments on opposite sides of the printed circuit board portions.

In some embodiments, the respective coupling regions may be defined by portions of the respective metal segments that extend toward the planar reflector at edges of adjacent ones of the arm segments.

In some embodiments, the respective coupling regions may be defined by plated through-hole vias.

In some embodiments, the respective coupling regions may be defined by portions of the respective metal segments comprising interdigitated fingers at edges of adjacent ones of the arm segments.

In some embodiments, the arm segments of the first and second pairs of dipoles may include segments that are bent at respective angles such that the arm segments collectively define an octagonal shape or a diamond shape in plan view; segments that are substantially linear such that the arm segments collectively define a rectangular shape in plan view; or segments comprising respective arc shapes such that the arm segments collectively define an elliptical shape in plan view.

In some embodiments, first and second pairs of feed stalks may extend from the planar reflector towards the first and second pairs of dipoles, respectively. The printed circuit board portions of the first and second pairs of dipoles may comprise respective slots therein that are adapted to mate with respective tabs of the first and second pairs of feed stalks, respectively.

Further features, advantages and details of then present disclosure, including any and all combinations of the above embodiments, will be appreciated by those of ordinary skill in the art from a reading of the figures and the detailed description of the embodiments that follow, such description being merely illustrative of the present disclosure.

DETAILED DESCRIPTION OF EMBODIMENTS

Figure 1A:
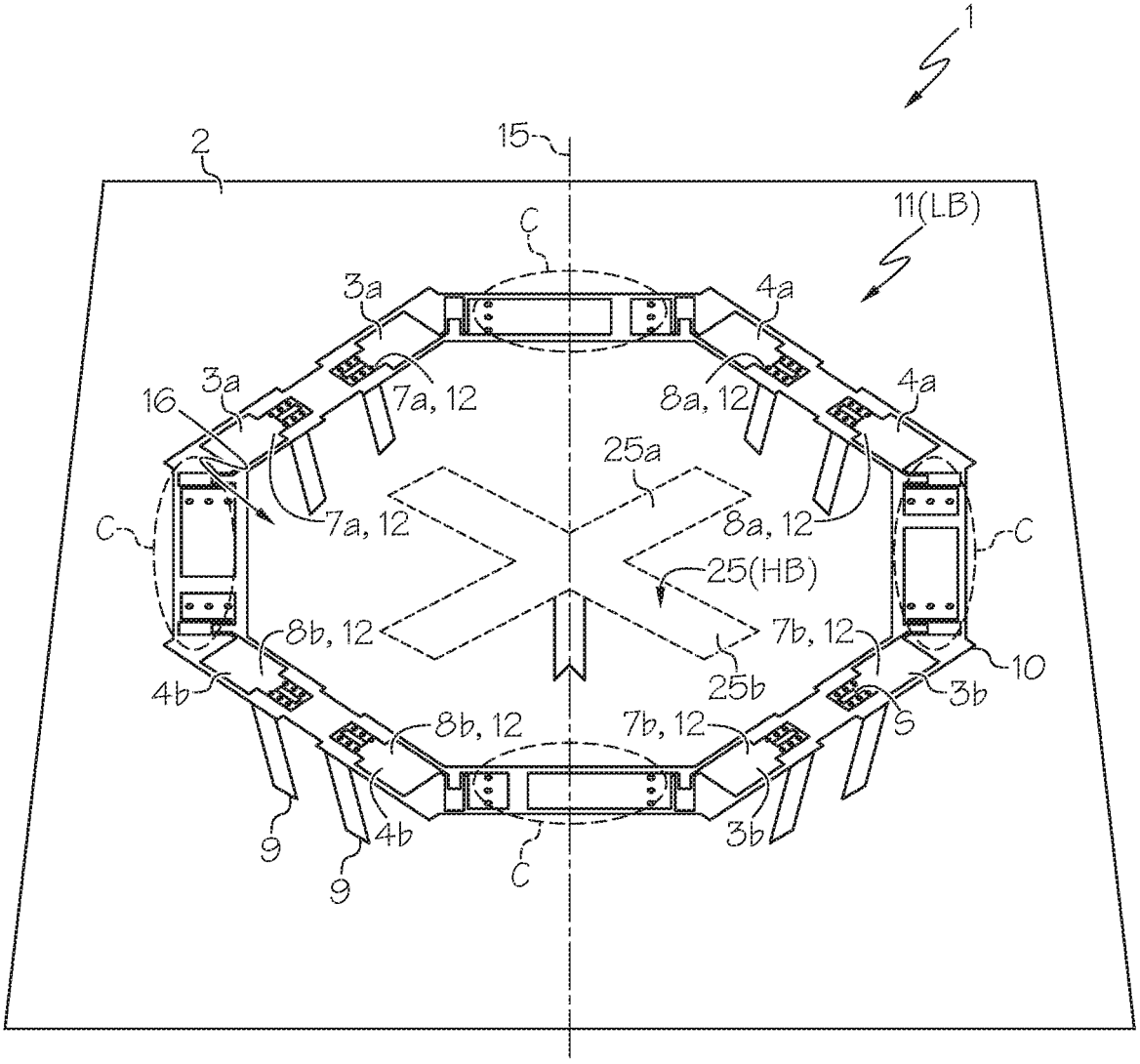
FIG. 1A is a front perspective view of an antenna arrangement including a low-band radiating element and a high-band radiating element in accordance with embodiments of the present disclosure.

Embodiments described herein relate generally to radiating elements (also referred to herein as "radiators") for dual- or multi-band cellular base station antenna (BSA) and such dual- or multi-band cellular base-station antennas. Such dual- or multi-band antennas can enable operators of cellular systems ("wireless operators") to use a single type of antenna covering multiple bands, where multiple antennas were previously required. Such antennas are capable of supporting several major air-interface standards in almost all the assigned cellular frequency bands and allow wireless operators to reduce the number of antennas in their networks, lowering tower leasing costs, installation costs, and reducing the load on the tower.

As used herein, "low-band" may refer to a lower operating frequency band for radiating elements described herein (e.g., 694-960 MHz), and "high-band" may refer to a higher operating frequency band for radiating elements described herein (e.g., 1695 MHz-2690 MHz). A "low-band radiating element" may refer to a radiating element for such a lower frequency band, while a "high-band radiating element" may refer to a radiating element for such a higher frequency band. "Dual-band" or "multi-band" as used herein may refer to antennas including both low-band and high-band radiating elements. Characteristics of interest may include the beam width and shape and the return loss.

A challenge in the design of such dual- or multi-band antennas is reducing or minimizing the effects of scattering of the signal at one band by the radiating elements of the other band(s). Embodiments described herein can reduce or minimize the effects of the high-band radiating elements on the radiation patterns of the low-band radiating elements, or vice versa. This scattering can affect the shapes of the high-band beam in both azimuth and elevation cuts and may vary greatly with frequency. In azimuth, typically the beamwidth, beam shape, pointing angle, gain, and front-to-back ratio can all be affected and can vary with frequency, often in an undesirable way. Because of the periodicity in the array introduced by the low-band radiating elements, grating lobes (sometimes referred to as quantization lobes) may be introduced into the elevation pattern at angles corresponding to the periodicity. This may also vary with frequency and may reduce gain.

Embodiments described herein relate more specifically to antennas with interspersed radiating elements for cellular base station use. In an interspersed design, the low-band radiating elements may be arranged or located on an equally-spaced grid appropriate to the frequency. The low-band radiating elements may be placed at intervals that are an integral number of high-band radiating elements intervals (often two such intervals), and the low-band radiating elements may occupy gaps between the high-band radiating elements. The low-band radiating elements and/or the high-band radiating elements may be dual-polarized, e.g., dual-slant polarized with +/−45 degree slant polarizations. Two polarizations may be used, for example, to overcome of multipath fading by polarization diversity reception. Examples of some conventional BSAs that include a crossed dipole antenna element are described in U.S. Pat. No. 7,053,852, while examples of some conventional BSAs that include a dipole square ("box dipole") having 4 to 8 dipole arms are described in U.S. Pat. Nos. 7,688,271, 6,339,407 or 6,313,809. Each of these patents is incorporated by reference. The +/−45 degree slant polarization is often desirable on multiband antennas. However, some conventional crossed-dipole-type elements, for example, may have undesirable coupling with crossed-dipole elements of another band situated on the same antenna panel. This is due, at least in part, to the orientation of the dipoles at +/−45 degree to the vertical axis of the antenna.

In some conventional multiband antennas, the radiating elements of the different bands of elements are combined on a single panel. See, e.g., U.S. Pat. No. 7,283,101, FIG. 12; U.S. Pat. No. 7,405,710, FIG. 1, FIG. 7. In these dual-band antennas, the radiating elements are typically aligned along a single vertically-oriented axis. This is done to reduce the width of the antenna when going from a single-band to a dual-band antenna. Low-band elements are the largest elements, and typically require the most physical space on a panel antenna. The radiating elements may be spaced further apart to reduce coupling, but this increases the size of the antenna and may produce grating lobes. An increase in panel antenna size may have undesirable drawbacks. For example, a wider antenna may not fit in an existing location, or the tower may not have been designed to accommodate the extra wind loading of a wider antenna. Also, zoning regulations can prevent of using bigger antennas in some areas.

Some embodiments of the present disclosure may arise from realization that performance of antennas including both low-band and high-band radiating elements may be improved by including an inductor-capacitor circuit on one or more arm segments of a low-band radiating element (e.g., operating in a frequency range of about 694 MHz to about 960 MHz) to provide cloaking with respect to high-band radiation (e.g., having a frequency range of about 1695 MHz to about 2690 MHz). Such an arrangement may reduce or minimize interaction between low- and high-band radiating elements in a dual-polarization, dual-band cellular base station antenna. Particular embodiments may provide the first and second pairs of dipoles of the low-band radiating element in a box- or ring-type dipole arrangement, for example, using a printed circuit board (PCB) structure. In some embodiments, some of the high-band radiating elements may be arranged adjacent to and/or within a perimeter defined by the arm segments of a low-band radiating element. Low-band radiating elements and/or configurations as described herein may be implemented in multi-band antennas in combination with antennas and/or features such as those described in commonly-assigned U.S. patent application Ser. No. 14/683,424 filed Apr. 10, 2015, U.S. patent application Ser. No. 14/358,763 filed May 16, 2014, and/or U.S. patent application Ser. No. 13/827,190 filed Mar. 14, 2013, the disclosures of which are incorporated by reference herein.

FIG. 1A is a front perspective view of an antenna arrangement 1 including a low-band (LB) radiating element 11 and a high-band radiating element 25 in accordance with embodiments of the present disclosure. Referring to FIG. 1A, a dual-polarized dipole antenna is implemented as a low-band radiating element 11 mounted on or in front of a planar base 2. The base 2 provides support for the low-band radiating element 11, as well as providing an electrical ground plane and back reflector for the low-band radiating element 11. The base 2 also includes a feed network (not shown).

The low-band radiating element 11 includes two pairs of dipoles 3*a*, 3*b* and 4*a*, 4*b* defined by electrically conductive segments 12 on a support structure 10, illustrated in FIG. 1A as a printed circuit board (PCB) structure. The PCB structure 10 defines arm segments 7*a*, 7*b* and 8*a*, 8*b* of the two pairs of dipoles 3*a*, 3*b* and 4*a*, 4*b*. The first pair of dipoles 3*a*, 3*b* is oriented at an angle of −45° to a longitudinal antenna axis 15, and a second pair of dipoles 4*a*, 4*b* is oriented at an angle of +45° to the antenna axis 15. The two pairs of dipoles 3*a*, 3*b* and 4*a*, 4*b* are arranged in a non-intersecting, box-dipole arrangement. The first pair of dipoles 3*a*, 3*b* includes arm segments 7*a*, 7*b* on opposite sides of the low-band radiating element 11, and the second pair of dipoles 4*a*, 4*b* includes arm segments 8*a*, 8*b* on opposite sides of the low-band radiating element 11. These opposite arm segments 7*a* and 7*b* (also referred to herein as "opposing" arm segments), together with opposing arm segments 8*a* and 8*b*, collectively define a perimeter around a central region 16. In contrast, a crossed-dipole antenna may include a single pair of dipoles that intersect at the center of the antenna.

A plurality of legs 9 are positioned around the central region 16 to support the low-band radiating element 11 over the base 2. The PCB structure 10 may include respective openings or slots S therein that are sized and configured or otherwise adapted to accept or mate with corresponding tabs of the legs 9, such that each dipole 3*a*, 3*b* and 4*a*, 4*b* is supported by a pair of the legs 9. The legs 9 may also be implemented by a PCB structure, and one or more of the legs 9 may be feed stalks including conductive segments 24 thereon, that define transmission lines to carry RF signals between a feed network on the base 2 and the low-band radiating element 11. For example, in some embodiments, each leg 9 may be defined by a support printed circuit board extending from the planar reflector 2 to support one of the arm segments 7*a*, 7*b*, 8*a*, 8*b*. Feed lines 24 may be defined by conductive metal segments that extend on the support printed circuit board of each pair of legs 9, from the planar reflector 2 towards the dipoles 3*a*, 3*b*, 4*a*, 4*b*. As such, each dipole 3*a*, 3*b*, 4*a*, 4*b* defines a center-fed arrangement with two arm segments. Each pair of legs 9 may also include a balun which extends on the support printed circuit board 9 and is connected to the feed line 24 at an end thereof proximate the respective one of the dipoles 3*a*, 3*b*, 4*a*, 4*b*.

The two pairs of dipoles 3*a*, 3*b*, 4*a*, 4*b* may be proximity fed by the baluns to radiate electrically in two polarization planes simultaneously. The low-band radiating element 11 is configured to operate at a low-band frequency range of 694-960 MHz, although the same arrangement can be used to operate in other frequency ranges. The proximity-fed arrangement (in which the baluns are spaced apart from the dipoles so that they field-couple with the dipoles) may result in higher bandwidth compared with a conventional direct-fed antenna (in which the dipoles are physically connected to the feed probe by a solder joint). Also the lack of solder joints resulting from the proximity-fed arrangement may result in less risk of passive intermodulation distortion and lower manufacturing costs compared with a conventional direct-fed antenna.

Figure 1B:
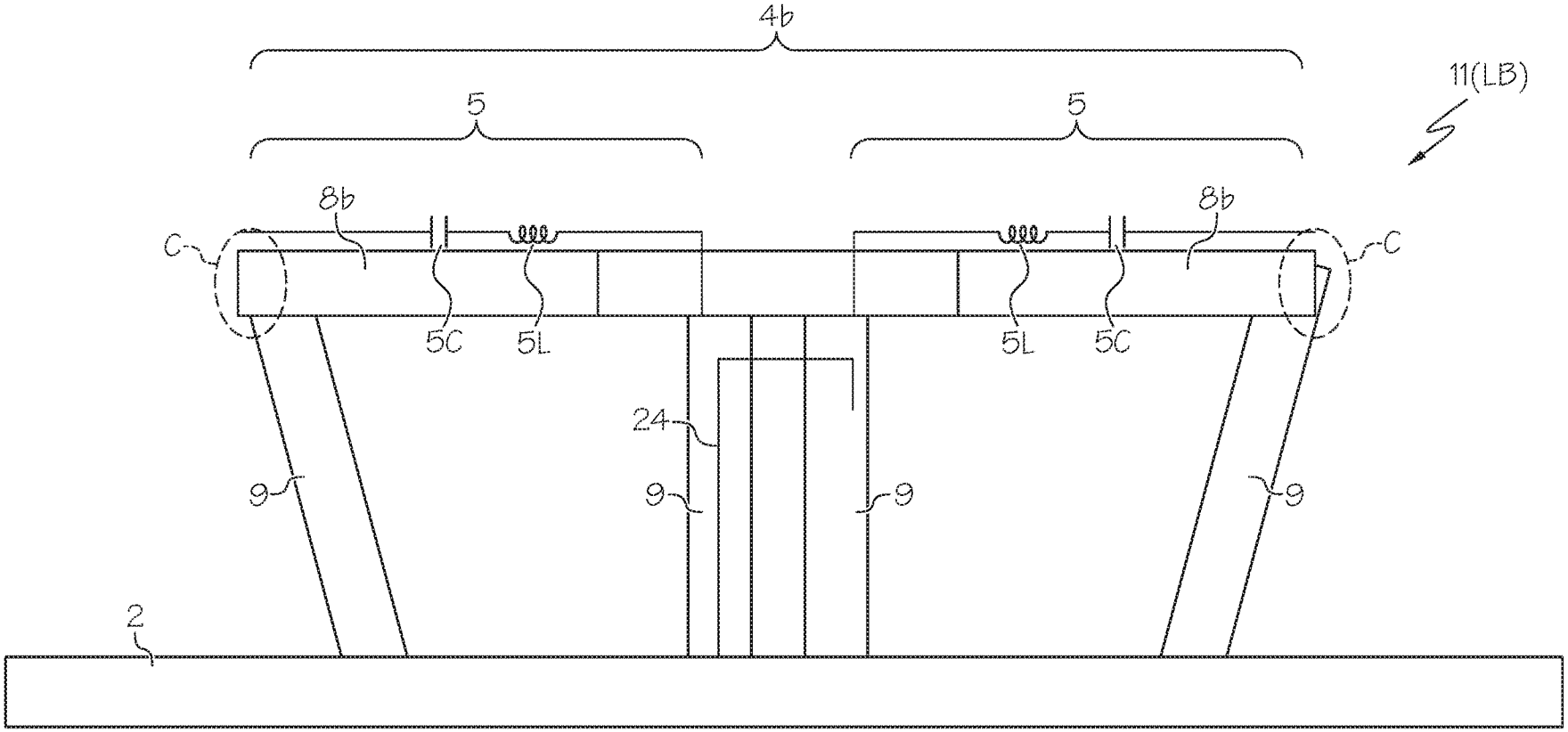
FIG. 1B is a side view of a low-band radiating element in accordance with embodiments of the present disclosure.

FIG. 1B is a side view of the low-band radiating element 11 of FIG. 1A. In particular, the side view of FIG. 1B illustrates elements of dipole 4*b* of FIG. 1A. However, it will be understood that the remaining dipoles 3*a*, 3*b*, and 4*a* may include corresponding elements in some embodiments, the description of which will not be repeated for brevity.

Referring FIGS. 1A and 1B, the arm segments 7*a*, 7*b* and 8*a*, 8*b* are portions of a structure 10, illustrated as an octagon-shaped printed circuit board (PCB) structure. The PCB structure 10 includes respective metal segments 12 in the form of conductive traces thereon. The PCB structure 10 may be a single substrate with conductive traces on both sides, or may be a bonded set of substrates to form a bonded printed circuit board with conductive traces on both sides and in between the bonded substrates. The metal segments 12 on the arms may define inductors 5L (for example, in the form of meandering transmission line segments) and capacitors 5C, which form a series inductor-capacitor circuit 5 on one or more of the arm segments 7*a*, 7*b*, 8*a*, 8*b*. In some embodiments, each of the arm segments 7*a*, 7*b* and 8*a*, 8*b* includes a respective inductor-capacitor circuit 5 thereon. The inductor-capacitor circuits 5 define a band-stop filter aligned to a frequency range higher than an operating frequency range of the pairs of dipoles 3*a*, 3*b* and 4*a*, 4*b*. The band-stop filter defined by the inductor-capacitor circuits 5 may thus be configured to pass frequencies of operation of the low-band radiating element 11 unaltered, but attenuate frequencies in a specific frequency range.

An advantage of the configuration shown in FIGS. 1A-1B is that the box-dipole low-band radiating element 11 leaves the central region 16 of the ground plane 2 unobstructed, such that a high-band (HB) radiating element 25 can be positioned within the perimeter defined by the arm segments 7*a*, 7*b*, 8*a*, 8*b* without increasing the physical size of the antenna, while also providing reduced interaction between the low-band and high-band radiating elements as described in greater detail herein. For example, the high-band radiating element 25 may include a pair of crossed dipoles 25*a* and 25*b* inclined at angles of +45° and −45° relative to the antenna axis 15 so as to radiate dual slant polarization. The dipoles 25*a* and 25*b* may be implemented as bow-tie dipoles or other wideband dipoles. While a specific configuration of the dipoles 25*a* and 25*b* of the high-band radiating element 25 is shown, other dipoles may be implemented using tubes or cylinders or as metallized tracks on a printed circuit board, for example. In some embodiments, the high-band radiating element 25 may be positioned in a "moat," described for example in U.S. patent application Ser. No. 14/479,102, the disclosure of which is incorporated by reference. A hole can be cut into the planar reflector 2 around the vertical structure of the box-dipole low-band radiating element 11, and a conductive well may be inserted into the hole. The feed board for the high-band radiating element 25 may be extended to the bottom of the well, which can lengthen the feed board and may move the CM resonance lower and out of band, while at the same time keeping the arms of the dipoles 25*a* and 25*b* approximately one quarter wavelength above the reflector.

The band-stop filter defined by the inductor-capacitor circuits 5 of FIG. 1B may be configured to attenuate (i.e., may be "aligned to") frequencies corresponding to the operating frequency range of the high-band radiating element 25, that is, about 1.7 GHz to about 2.7 GHz in some embodiments. In other words, the low-band radiating element 11 may be configured to "cloak" the operating frequency range of the high-band radiating element 25, thereby reducing distortion in the radiation patterns of the low-band radiating elements due to operation of the high-band radiating elements 25 (or vice versa), and providing improved performance in multi-band antennas that include both low-band radiating elements 11 and high-band radiating elements 25.

Figure 1C:
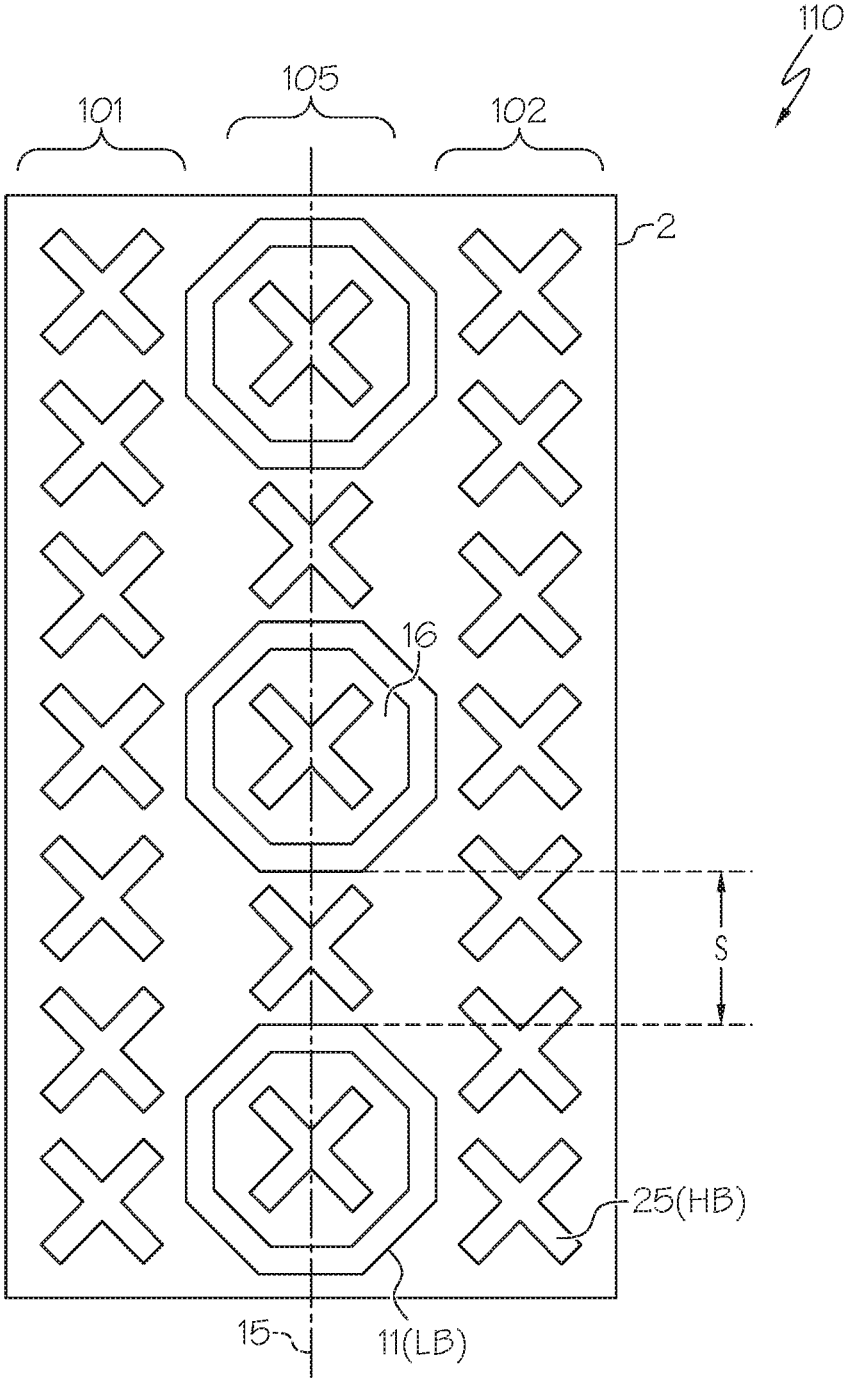
FIG. 1C is a plan view illustrating a multi-band antenna including low-band radiating elements and high-band radiating elements according to embodiments of the present disclosure.
Figure 1D:
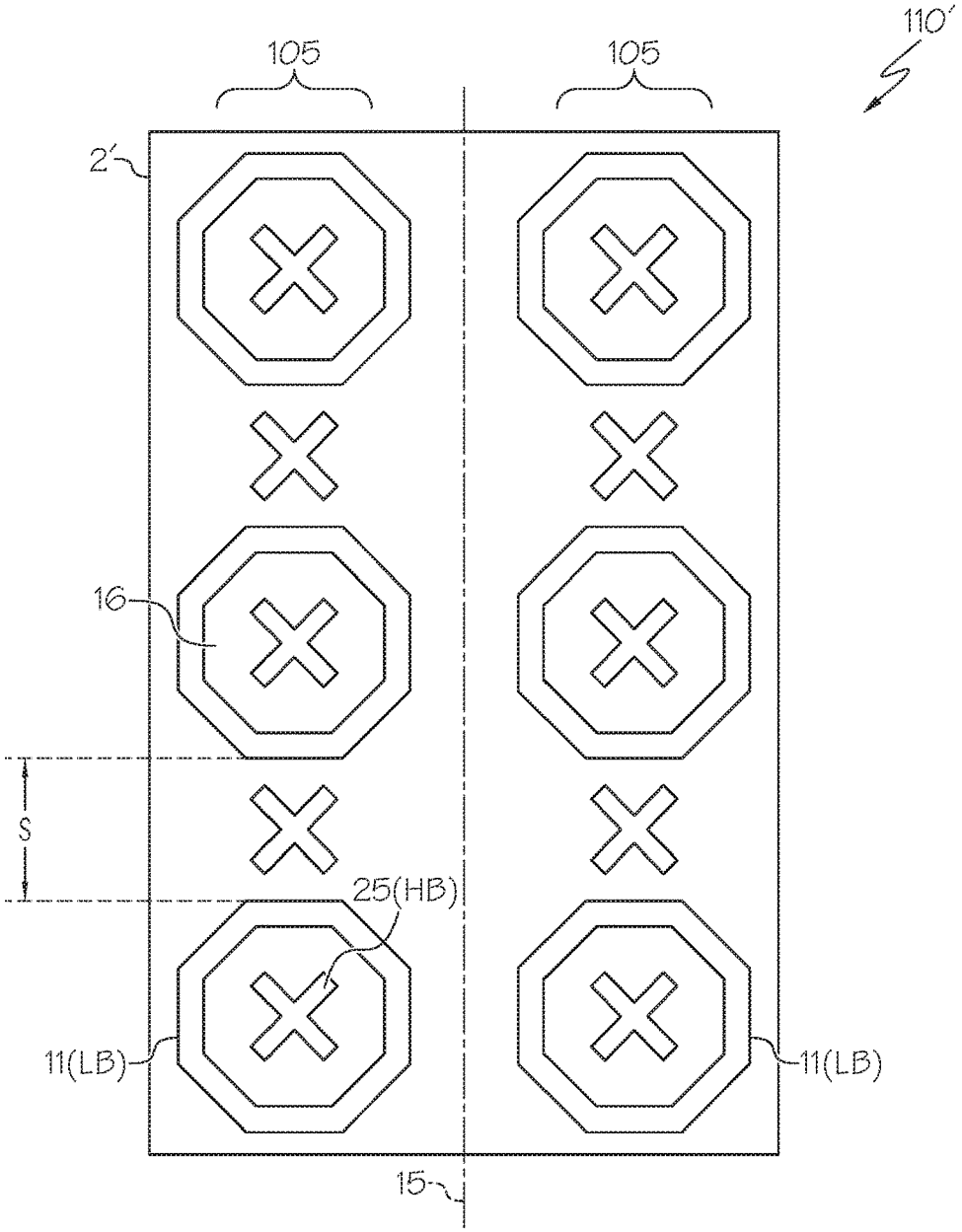
FIG. 1D is a plan view illustrating a multi-band antenna including low-band radiating elements and high-band radiating elements according to further embodiments of the present disclosure.

FIG. 1C is a plan view illustrating a dual-band antenna array 110 including low-band radiating elements 11 and high-band radiating elements 25 according to embodiments of the present disclosure. The antenna array 110 includes multiple of the box-dipole low-band radiating elements 11 arranged in a column 105 along the antenna axis 15, which is generally aligned vertically (or slightly tilted down). A column 101 of high-band radiating elements 25 to the left of the axis 15 may define a first high-band array and a column 102 of high-band radiating elements 25 to the right of the axis 15 may define a second high band array. As noted with reference to FIG. 1A, the low-band radiating elements 11 are configured to radiate dual slant polarizations (linear polarizations inclined at +45 degrees and −45 degrees relative to the vertical antenna axis 15), and provide clear areas 16 on the ground plane 2 for arranging respective high-band radiating elements 25 of the dual-band antenna array 110 within a perimeter thereof. The low-band radiating elements 11 may be spaced apart along the antenna axis 15 by an element spacing S. In some embodiments, the element spacing S may be sufficient to fit one or more high-band radiating elements 25 between adjacent low-band radiating elements 11 along the direction of the column 105. FIG. 1D is a plan view illustrating an alternate arrangement for a dual band antenna array 110' including multiple columns 105 of low-band radiating elements 11 and high-band radiating elements 25 interspersed therebetween on a planar reflector 2'.

Referring again to FIGS. 1A and 1B, the arm segments of each of the first pair of dipoles 3*a*, 3*b* are capacitively coupled to the arm segments of each of the second pair of dipoles 4*a*, 4*b* adjacent thereto by respective coupling regions C therebetween. That is, dipole 3*a* is capacitively coupled to dipoles 4*a* and 4*b* at respective ends thereof by coupling regions C; dipole 3*b* is capacitively coupled to dipoles 4*a* and 4*b* at respective ends thereof by coupling regions C; dipole 4*a* is capacitively coupled to dipoles 3*a* and 3*b* at respective ends thereof by coupling regions C; and dipole 4*b* is capacitively coupled to dipoles 3*a* and 3*b* at respective ends thereof by coupling regions C. In some embodiments, as shown for example in FIG. 2C, metal segments 12*a*, 12*b* on different or opposing faces (e.g., on top 10*a* and bottom 10*b*) of the PCB structure 10 may be used to implement the coupling regions C based on overlap of the metal segments 12*a*, 12*b*. In other embodiments, as shown for example in FIG. 3C, vertical overlap between metal segments 12*b*' extending towards the planar reflector 2 at edges of the arm segments 7*a* 7*b*, 8*a*, 8*b* on the bottom surface 10*b* of the PCB structure 10 may be used to implement the coupling regions C'. In contrast, some conventional box-dipole arrangements may use a sheet metal or die-casting support structure with coupling between arm segments provided below the support structure, which can negatively affect high-band radiation patterns.

Figure 1E:
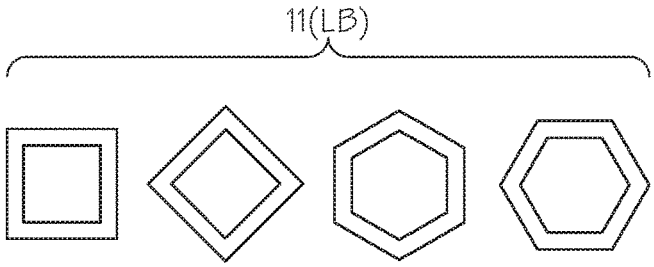
FIG. 1E illustrates schematic plan views of various configurations of low-band radiating elements according to embodiments of the present disclosure.

While the two pairs of dipoles of the low-band radiating element 11 are shown in an octagonal arrangement in FIGS. 1A-1D by way of example, other geometric configurations may be used in accordance with embodiments of the present disclosure. FIG. 1E illustrates specific examples of such low-band radiating element configurations, where the two pairs of dipoles can be arranged to define shapes including but not limited to square-, diamond-, elliptical-, or hexagonal-shaped arrangements. Examples of such arrangements are described herein in greater detail with reference to FIGS. 4-6. Box-dipole arrangements as described herein provide narrower azimuth beamwidth patterns (for improved directivity) in comparison to cross-dipole arrangements, such that multiple box-dipole antennas 11 can be arranged side-by-side in multi-band antennas. While shown in FIGS. 1C and 1D with reference to a multi-band antenna array including multiple octagonal-shaped low-band radiating elements, it will be understood that multi-band antennas as described herein are not limited to same-shaped low-band radiating elements, but rather, may include combinations of differently-shaped low-band radiating elements as described herein. More generally, although illustrated with reference to specific shapes in example embodiments, it will be understood other shapes may be used to implement the box-type dipole antennas described herein.

Figure 2A:
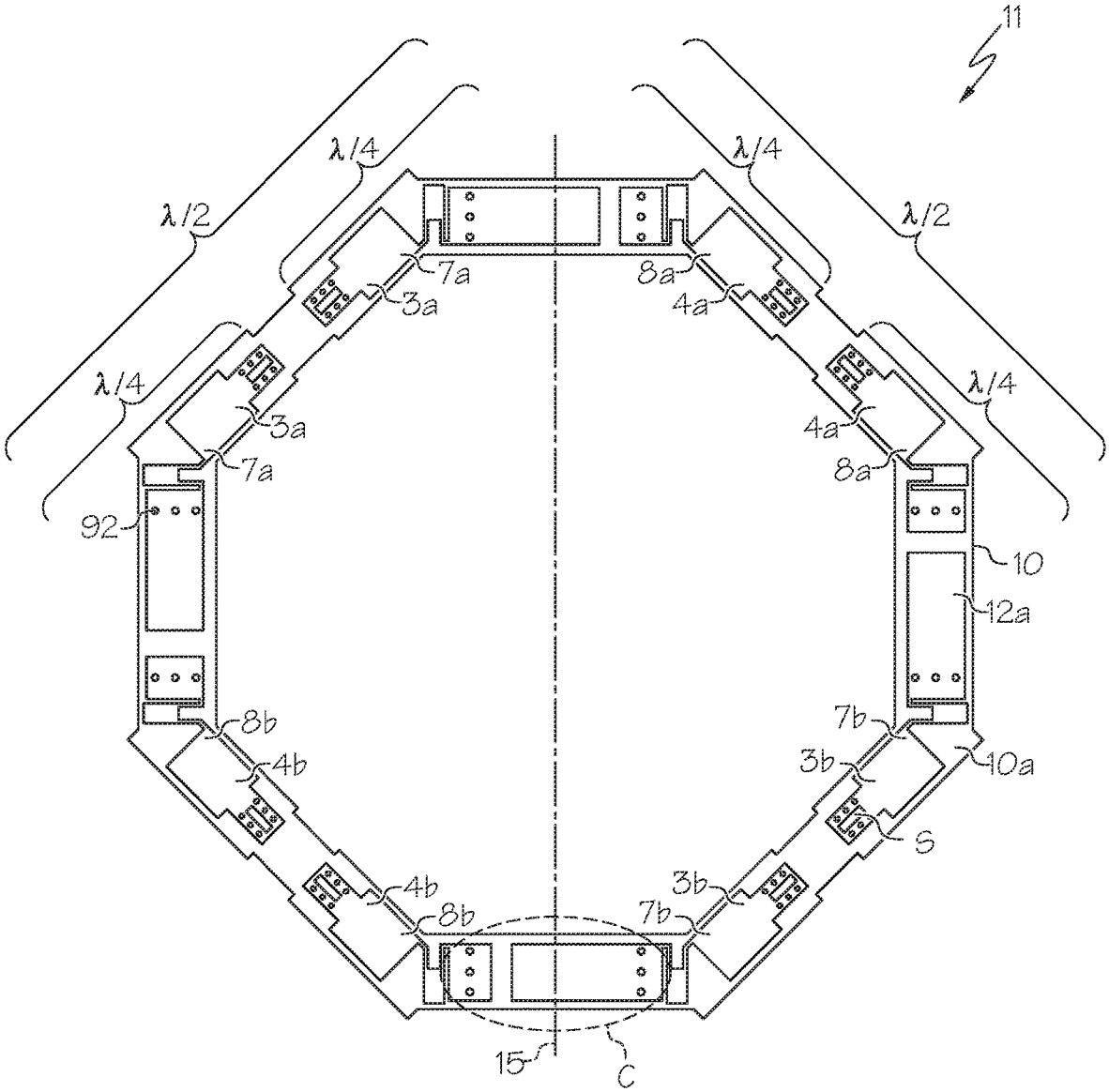
FIGS. 2A and 2B are plan views illustrating front and back surfaces, respectively, of dipoles of the low-band radiating element of FIG. 1A.
Figure 2B:
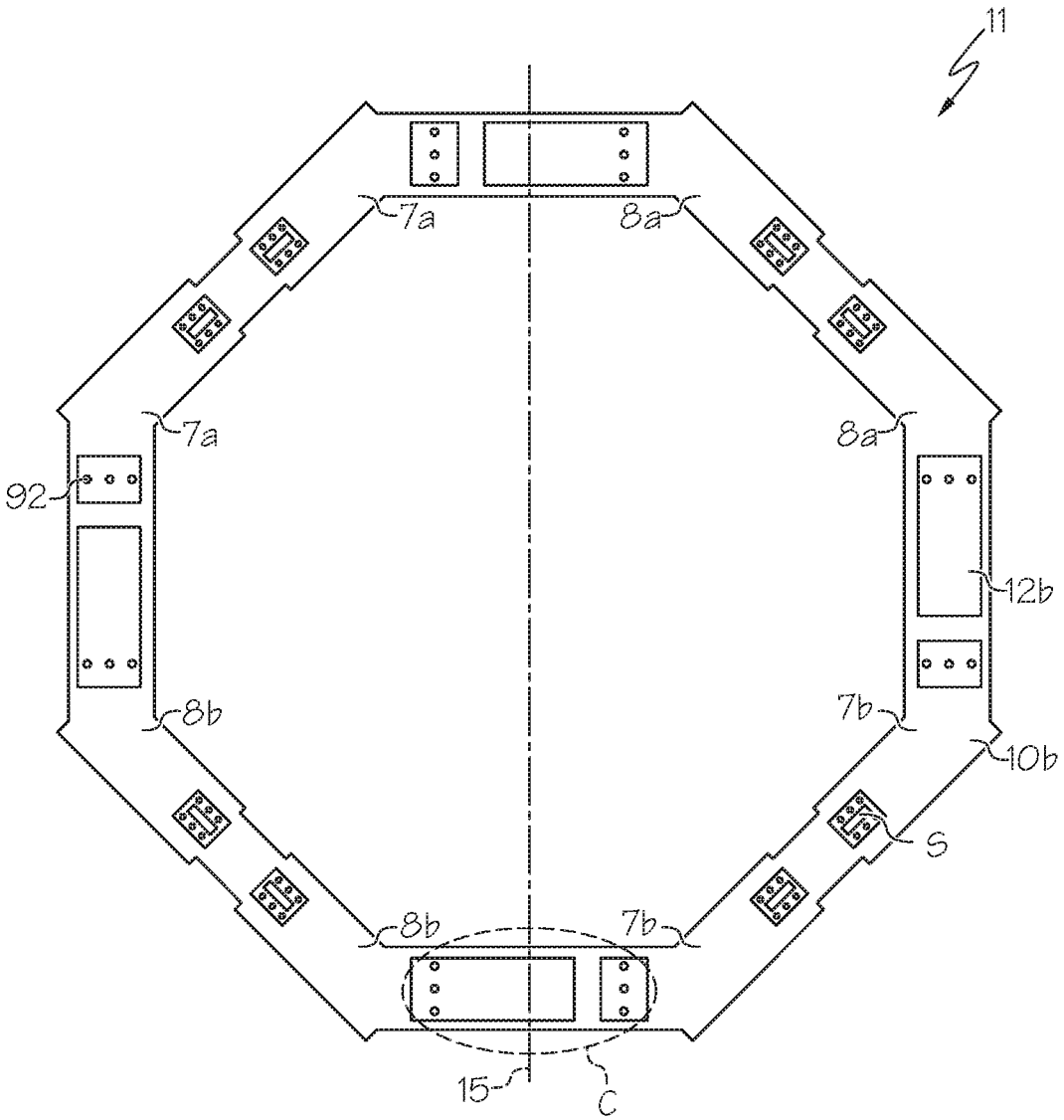

FIGS. 2A and 2B are top and bottom views illustrating front and back surfaces 10*a* and 10*b*, respectively, of the low-band radiating element 11 of FIG. 1A in accordance with embodiments of the present disclosure. As shown in FIGS. 2A and 2B, the two pairs of dipoles 3*a*, 3*b* and 4*a*, 4*b* are provided in a box-dipole arrangement on the PCB structure 10. The first pair of dipoles 3*a* and 3*b* includes opposing arm segments 7*a* and 7*b*, respectively, while the second pair of dipoles 4*a* and 4*b* includes opposing arm segments 8*a* and 8*b*, respectively. The arm segments 7*a*, 7*b*, 8*a*, 8*b* are defined by conductive metal segments 12 on portions of the PCB structure 10. The conductive metal segments 12 include metal segments 12*a* on the front/top surface 10*a* of the PCB structure 10, and metal segments 12*b* on the opposing back/bottom surface 10*b* of the PCB structure 10. The metal segments 12*a*, 12*b* on the opposing surfaces 10*a*, 10*b* of the PCB are electrically connected by conductive vias 92 that extend through the PCB structure 10 from the front surface 10*a* to the back surface 10*b*. The conductive vias 92 may be plated through-hole vias in some embodiments.

As shown in FIGS. 2A and 2B, low-band radiating element 11 includes four half-wave (λ/2) dipoles 3*a*, 3*b* and 4*a*, 4*b* arranged in an octagonal shape on the PCB 10, where the first pair of dipoles 3*a*, 3*b* are opposite one another, and the second pair of dipoles 4*a*, 4*b* are opposite one another. The dipole pairs 3*a*, 3*b* and 4*a*, 4*b* are configured to radiate orthogonal polarizations. In the examples described herein, the dipole pairs 3*a*, 3*b* and 4*a*, 4*b* are configured to radiate dual slant polarizations (linear polarizations inclined at −45 degrees and +45 degrees relative to a vertical or longitudinal antenna axis 15), where the first pair of dipoles 3*a*, 3*b* are oriented at an angle of −45° to the antenna axis 15, and the second pair of dipoles 4*a*, 4*b* are oriented at an angle of +45° to the antenna axis 15.

The metal segments 12*a*, 12*b* of each arm segment 7*a*, 7*b*, 8*a*, 8*b* define quarter-wave (λ/4) dipoles. The metal segments 12*a*, 12*b* may define inductors and capacitors (5L and 5C shown in FIG. 1B), which form a series inductor-capacitor circuit on each of the arm segments 7*a*, 7*b*, 8*a*, 8*b*. For example, the enlarged plan view of FIG. 2D illustrates an arrangement where thinner portions 12*l* of the metal segments 12*a* define an inductor 5L of the series inductor-capacitor circuit, while portions 12*c* of the metal segments 12*a* with a gap therebetween define a capacitor 5C of the series inductor-capacitor circuit. In other embodiments, the inductors and/or capacitors may be coupled to and/or between portions of the metal segments. The inductor-capacitor circuits define a band-stop filter aligned to the operating frequency range of the high-band radiating element 25, such that frequencies between about 1.7 GHz to about 2.7 GHz are attenuated in some embodiments.

Figure 2C:
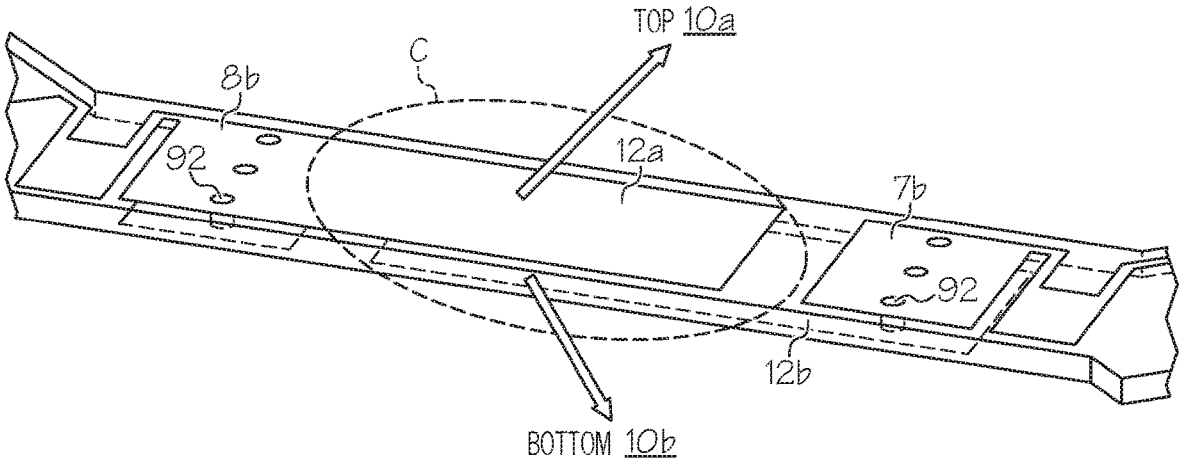
FIG. 2C is an enlarged perspective view of a coupling region of dipoles of the low-band radiating element of FIGS. 2A and 2B.
Figure 2D:
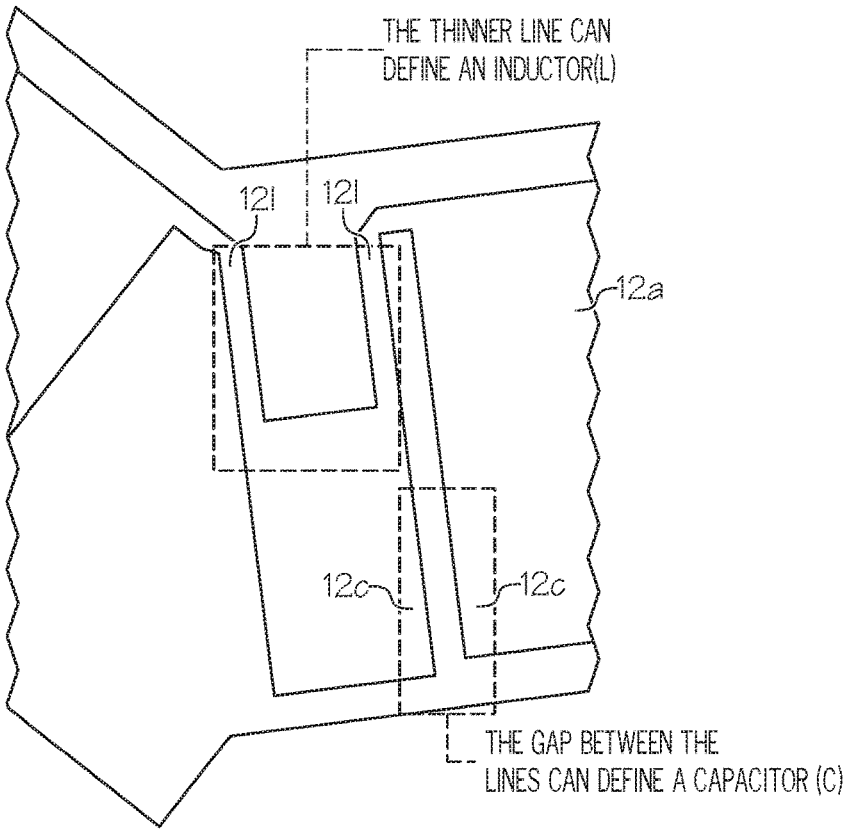
FIG. 2D is an enlarged plan view of a series inductor-capacitor circuit of the low-band radiating element of FIG. 1A.

FIG. 2C is an enlarged perspective view of a coupling region C of the low-band radiating element of FIGS. 2A and 2B. In particular, the enlarged view of FIG. 2C illustrates elements of the coupling region C between ends of adjacent dipoles 4*b* and 3*b* by way of example. It will be understood that coupling regions C between dipoles 3*a* and 4*a*, 3*a* and 4*b*, and 4*a* and 3*b* may include corresponding elements in some embodiments. As shown in FIG. 2C, an end of the arm segment 8*b* of dipole 4*b* is capacitively coupled to an end of the arm segment 7*b* of dipole 3*b* at coupling region C. The coupling region C is defined by overlapping portions of the respective metal segments 12*a*, 12*b* on opposite sides 10*a*, 10*b* of the PCB structure 10. That is, the overlap between the portions of the metal segments 12*a* and 12*b* (with the PCB structure 10 as a dielectric therebetween) defines the coupling region C.

Figure 3A:
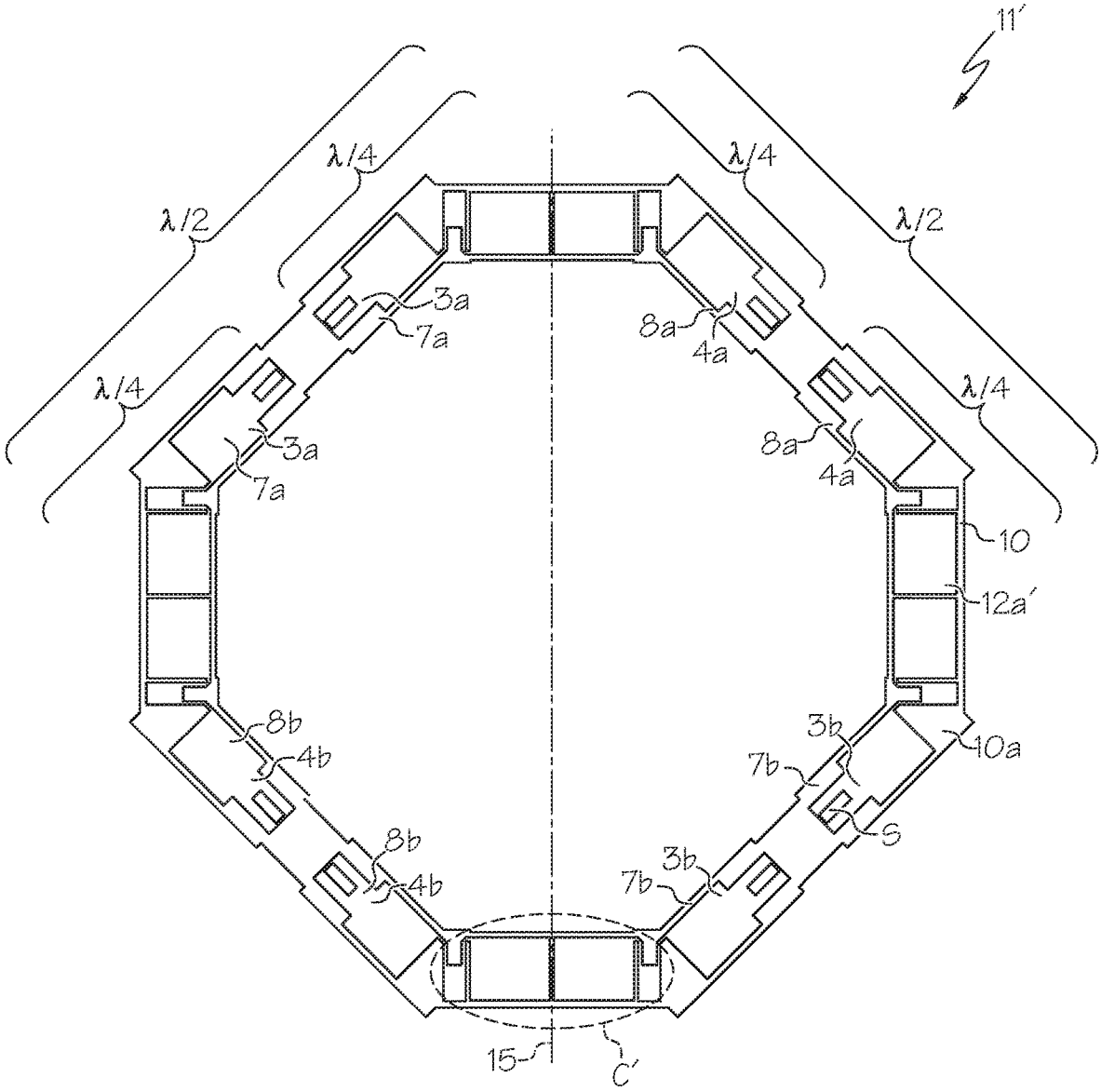
FIGS. 3A and 3B are plan views illustrating front and back surfaces, respectively, of dipoles of a low-band radiating element in accordance with embodiments of the present disclosure.
Figure 3B:
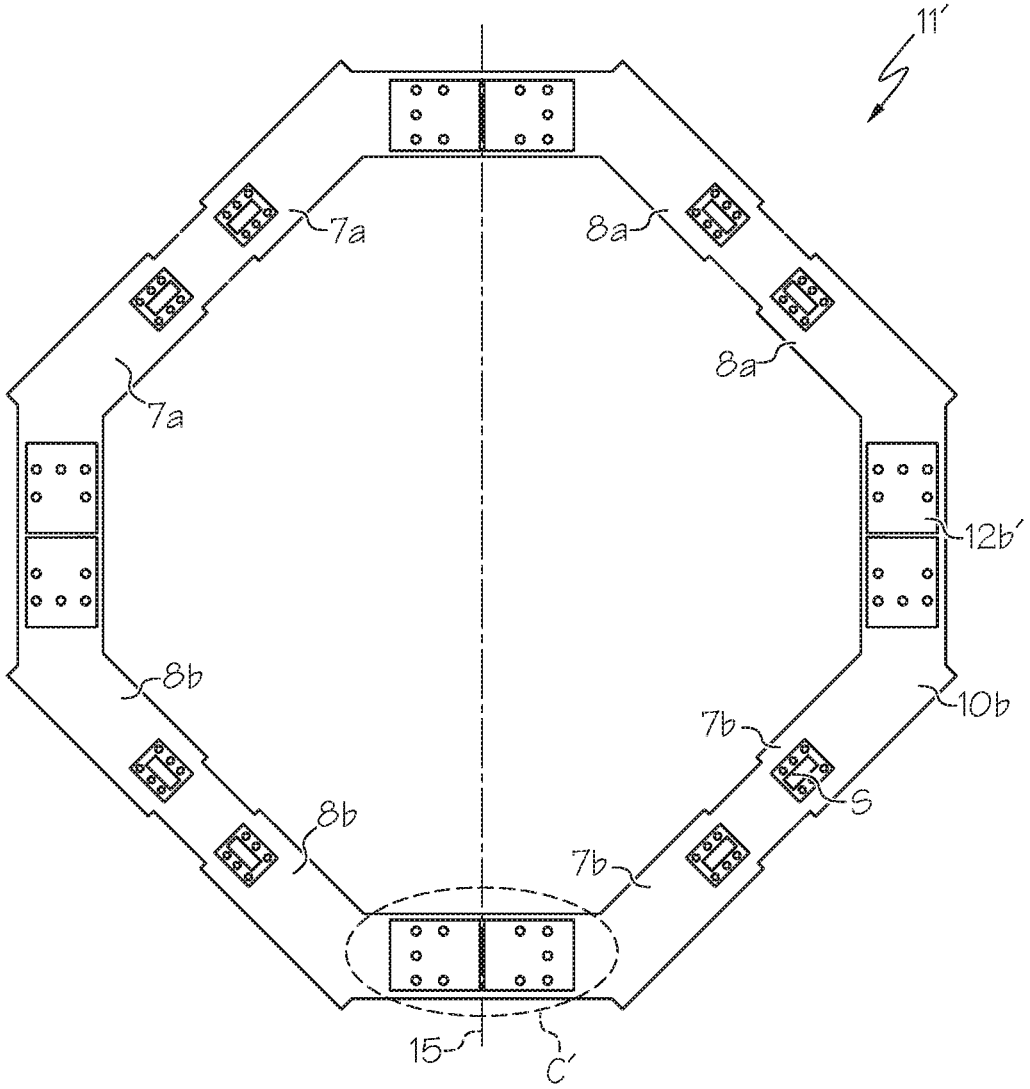
Figure 3C:
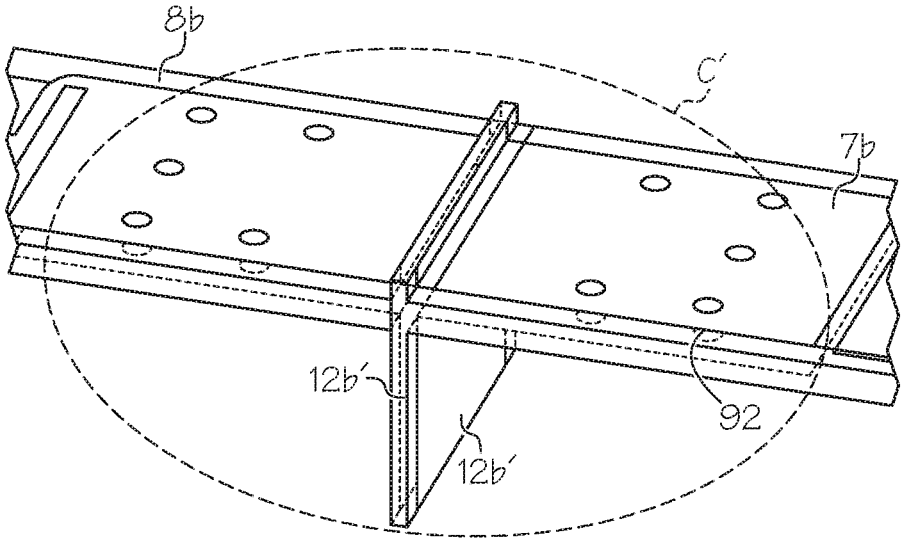
FIG. 3C is an enlarged perspective view of a coupling region of dipoles of the low-band radiating element of FIGS. 3A and 3B.

Coupling regions according to embodiments of the present disclosure may be implemented using additional or alternative configurations than those shown in FIG. 2C. For example, FIGS. 3A and 3B are top and bottom views illustrating front and back surfaces 10*a*' and 10*b*', respectively, of a low-band radiating element 11' in accordance with embodiments of the present disclosure, while FIG. 3C is an enlarged perspective view of a coupling region C' of the low-band radiating element 11' of FIGS. 3A and 3B. Some elements of FIGS. 3A-3C may be similar to those described above with reference to FIGS. 2A-2C.

Referring to FIGS. 3A-3C, the low-band radiating element 11' includes four half-wave (λ/2) dipoles 3*a*, 3*b* and 4*a*, 4*b* provided in a box-dipole arrangement on the octagon-shaped PCB 10 structure, where the first pair of dipoles 3*a*, 3*b* are opposite one another, and the second pair of dipoles 4*a*, 4*b* are opposite one another. The arm segments 7*a*, 7*b* and 8*a*, 8*b* of the dipoles 3*a*, 3*b* and 4*a*, 4*b* are defined by conductive metal segments 12*a*' and 12*b*' on the front/top surface 10*a* and the opposing back/bottom surface 10*b* of the PCB structure 10, where the metal segments 12*a*', 12*b*' of each arm segment 7*a*, 7*b*, 8*a*, 8*b* define quarter-wave (λ/4) dipoles. The first pair of dipoles 3*a*, 3*b* may be oriented at an angle of −45° to the antenna axis 15, and the second pair of dipoles 4*a*, 4*b* may be oriented at an angle of +45° to the antenna axis 15, such that the dipole pairs 3*a*, 3*b* and 4*a*, 4*b* are configured to radiate dual slant polarizations.

The metal segments 12*a*', 12*b*' may define or otherwise be coupled to inductors and capacitors (5L and 5C shown in FIG. 1B), which form a series inductor-capacitor circuit on each of the arm segments 7*a*, 7*b*, 8*a*, 8*b*. The inductor-capacitor circuits define a band-stop filter that is aligned to the operating frequency range of the high-band radiating element 25, that is, to attenuate frequencies between about 1.7 GHz to about 2.7 GHz in some embodiments.

The enlarged view of FIG. 3C illustrates elements of the coupling region C' between ends of adjacent dipoles 4*b* and 3*b* by way of example. It will be understood that similar coupling regions C' between dipoles 3*a* and 4*a*, 3*a* and 4*b*, and 4*a* and 3*b* may include corresponding elements in some embodiments. As shown in FIG. 3C, an end of the arm segment 8*b* of dipole 4*b* is capacitively coupled to an end of the arm segment 7*b* of dipole 3*b* at coupling region C'. In the example of FIG. 3C, the coupling region C' is defined by overlapping portions of the metal segments 12*b*' on the bottom surface 10*b* of the PCB structure 10, which extend away from the top surface 10*a* (e.g., toward the planar reflector 2) at edges of the adjacent arm segments 7*b*, 8*b*. That is, the overlap between the portions of the metal segments 12*b*' (with the PCB structure 10 as a dielectric therebetween) defines the coupling region C'. Conductive vias 92 electrically connect the portions of the metal segments 12*b*' on the bottom surface 10*b* of the PCB structure 10 to the metal segments 12*a*' on the top surface 10*a*.

Figure 3D:
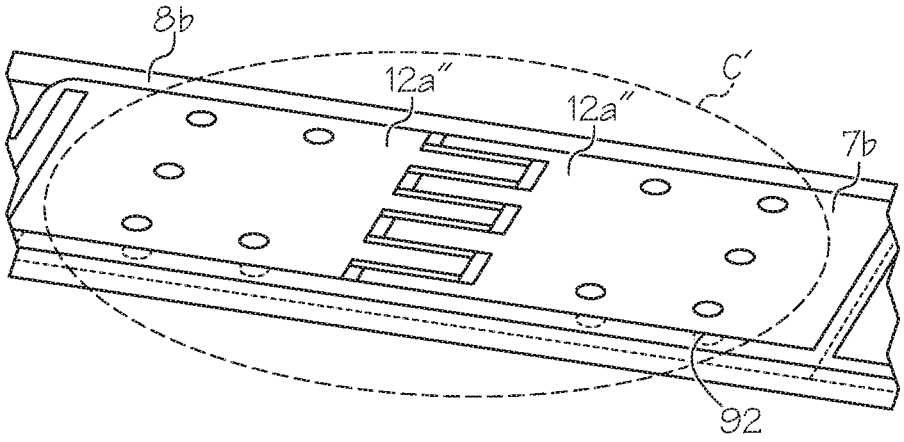
FIG. 3D is an enlarged perspective view of another coupling region of dipoles of the low-band radiating element of FIGS. 3A and 3B.
Figure 3E:
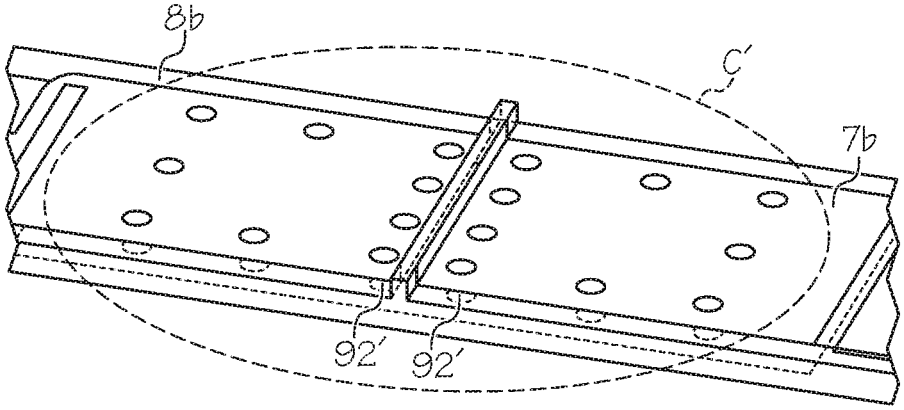
FIG. 3E is an enlarged perspective view of still another coupling region of dipoles of the low-band radiating element of FIGS. 3A and 3B.

Further coupling regions according to embodiments of the present disclosure may be implemented using additional or alternative configurations than those shown in FIGS. 2C and 3C. For example, in some embodiments as shown in FIG. 3D, the portions of the respective metal segments 12*a*" at adjacent ends of the arm segments 7*b*, 8*b* may define interdigitated fingers, which may provide capacitive coupling between the adjacent arm segments 7*b*, 8*b*. Also, in some embodiments as shown in FIG. 3E, each of the arm segments 7*b*, 8*b* may include conductive vias 92' (such as plated through-hole vias) at the edges thereof, and the conductive vias 92' may provide capacitive coupling between the adjacent arm segments 7*b*, 8*b*.

Figure 4:
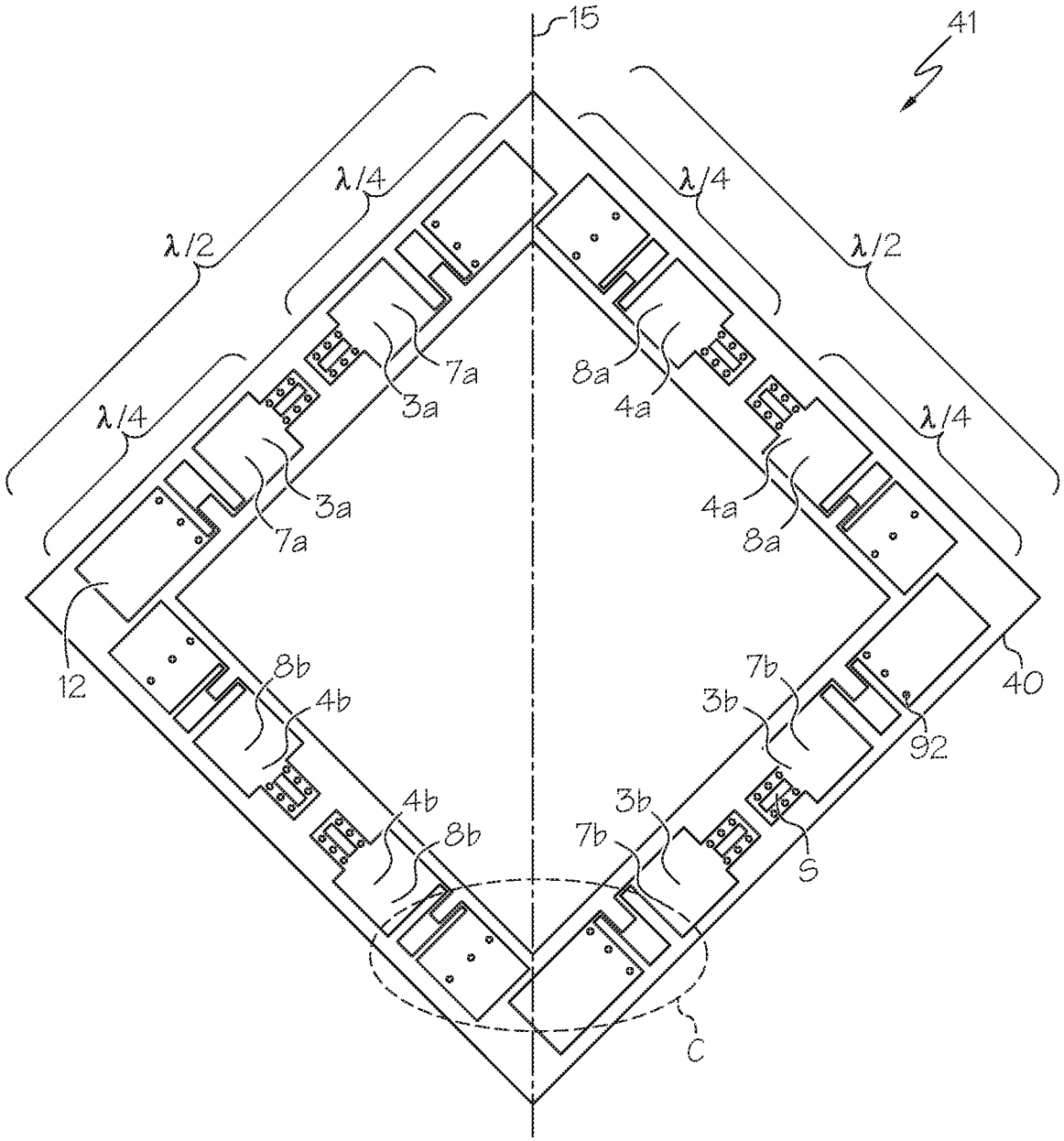
FIG. 4 is a plan view of the front surface of dipoles of a square-shaped low-band radiating element in accordance with embodiments of the present disclosure.
Figure 5:
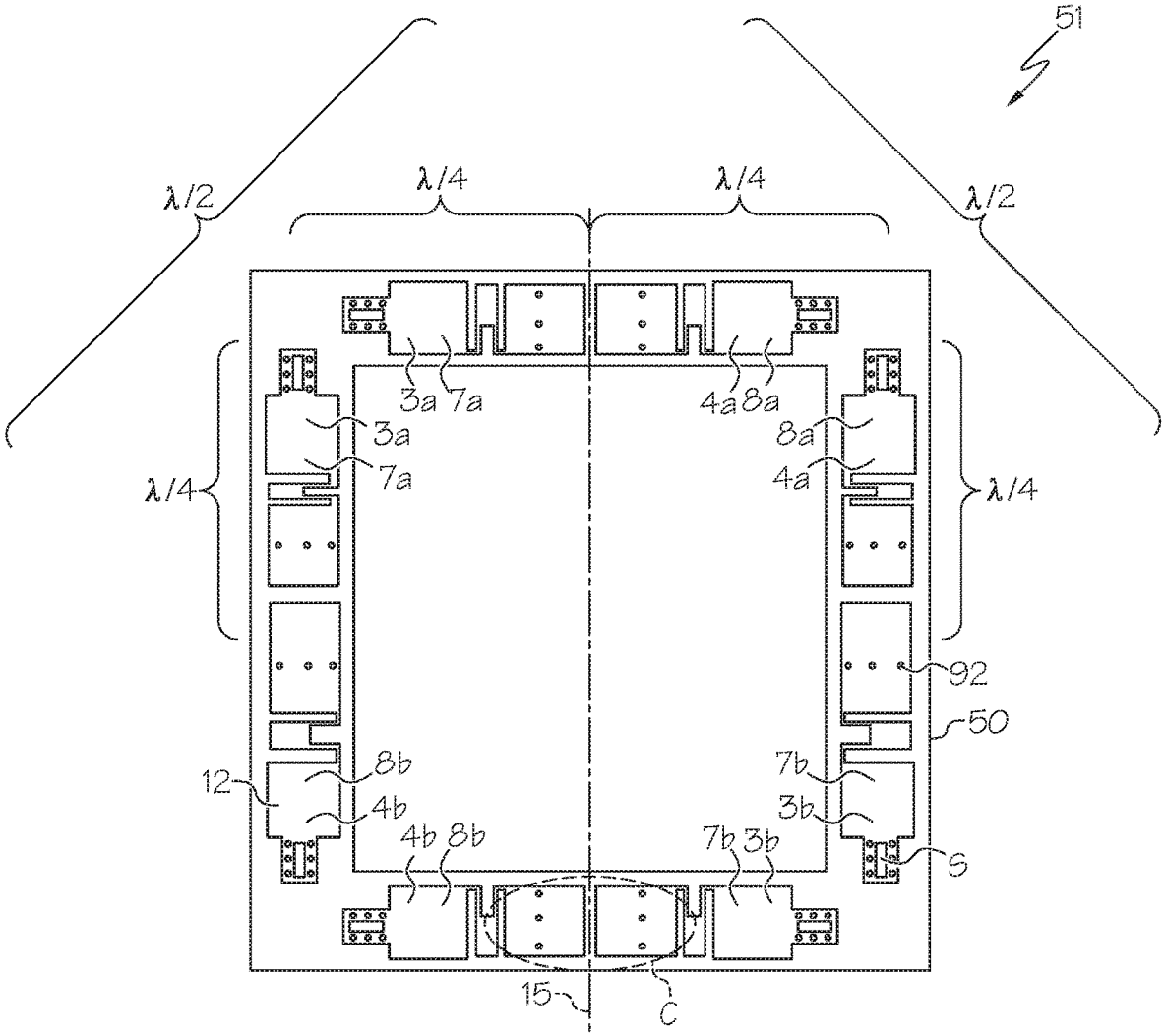
FIG. 5 is a plan view of the front surface of dipoles of a diamond-shaped low-band radiating element in accordance with embodiments of the present disclosure.
Figure 6:
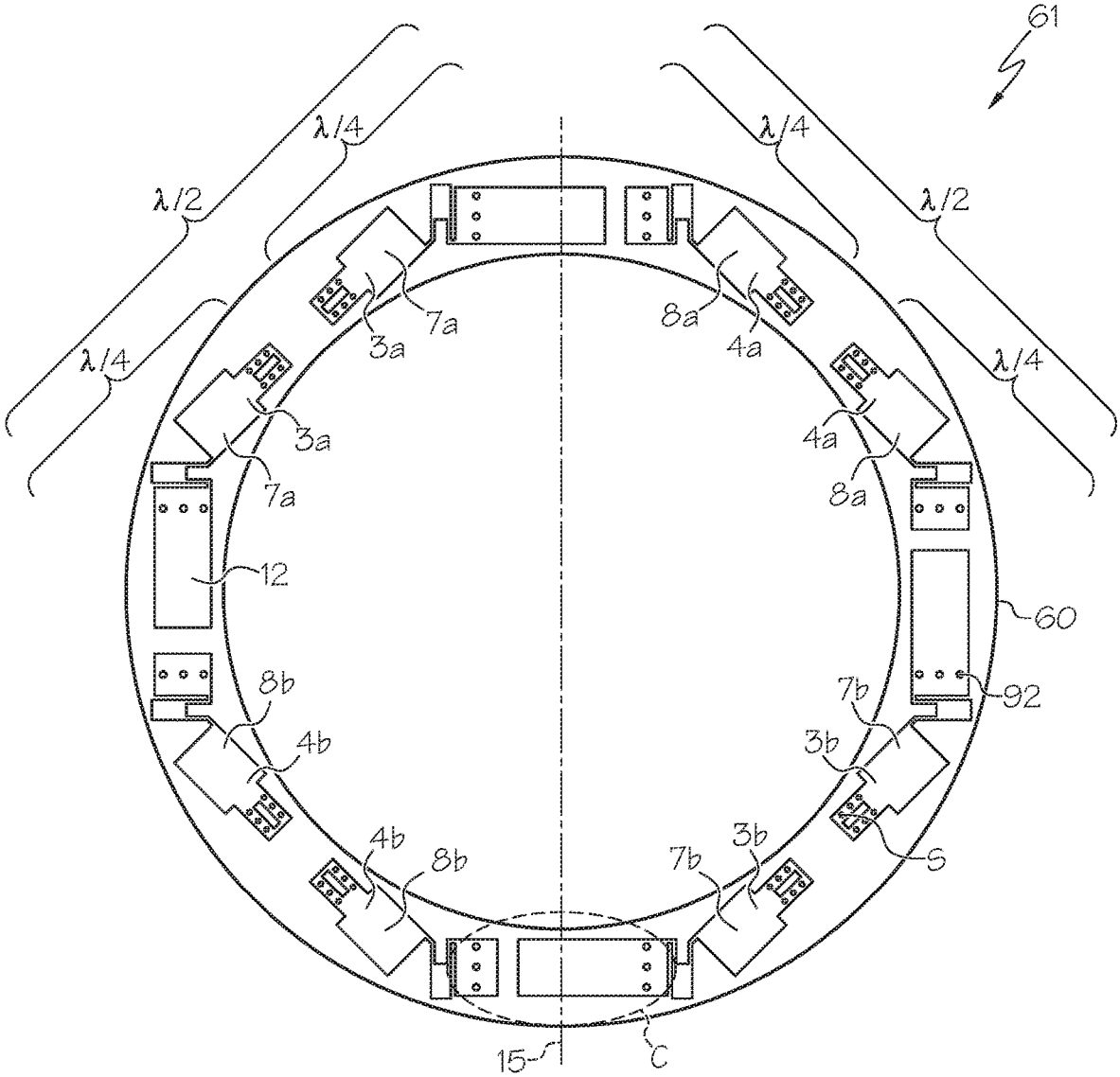
FIG. 6 is a plan view of the front surface of dipoles of a circular-shaped low-band radiating element in accordance with embodiments of the present disclosure.

FIGS. 4, 5, and 6 are plan views of front surfaces of low-band radiating elements 41, 51, and 61, respectively, in accordance with embodiments of the present disclosure. The embodiments of FIGS. 4, 5, and 6 illustrate configurations of the two pairs of dipoles 3*a*, 3*b* and 4*a*, 4*b* on differently-shaped PCB structures 40, 50, and 60. As such, some elements of FIGS. 4, 5, and 6 may be similar to those described above with reference to FIGS. 2A-2C and/or FIGS. 3A-3C.

In particular, FIG. 4 is a plan view of the front surface of a low-band radiating element 41 in accordance with embodiments of the present disclosure. In FIG. 4, the portions of the PCB structure 40 defining the arm segments 7*a*, 7*b* and 8*a*, 8*b* of the first and second pairs of dipoles 3*a*, 3*b* and 4*a*, 4*b* are substantially linear. As such, the arm segments 7*a*, 7*b* and 8*a*, 8*b* collectively define a rectangular shape (shown as a square shape) in plan view.

In greater detail, the low-band radiating element 41 includes four half-wave (λ/2) dipoles 3*a*, 3*b* and 4*a*, 4*b* provided in a box-dipole arrangement on the square-shaped PCB structure 40, where the first pair of dipoles 3*a*, 3*b* are opposite one another, and the second pair of dipoles 4*a*, 4*b* are opposite one another. The arm segments 7*a*, 7*b* and 8*a*, 8*b* of the dipoles 3*a*, 3*b* and 4*a*, 4*b* may be defined by conductive metal segments 12 on the front/top surface and/or the back/bottom surface of the PCB structure 40, where the metal segments 12 of each arm segment 7*a*, 7*b*, 8*a*, 8*b* define quarter-wave (λ/4) dipoles. The first pair of dipoles 3*a*, 3*b* may be oriented at an angle of −45° to the antenna axis 15, and the second pair of dipoles 4*a*, 4*b* may be oriented at an angle of +45° to the antenna axis 15, such that the dipole pairs 3*a*, 3*b* and 4*a*, 4*b* are configured to radiate dual slant polarizations. The metal segments 12 may define or otherwise be coupled to inductors and capacitors (5L and 5C shown in FIG. 1B), which form a series inductor-capacitor circuit on each of the arm segments 7*a*, 7*b*, 8*a*, 8*b*. The inductor-capacitor circuits define a band-stop filter configured to "cloak" a higher operating frequency range (e.g., about 1.7 GHz to about 2.7 GHz) in some embodiments.

FIG. 5 is a plan view of the front surface of a low-band radiating element 51 in accordance with embodiments of the present disclosure. In FIG. 5, the portions of the PCB structure 50 defining the arm segments 7*a*, 7*b* and 8*a*, 8*b* of the first and second pairs of dipoles 3*a*, 3*b* and 4*a*, 4*b* are 'bent' at respective angles. As such, the arm segments 7*a*, 7*b* and 8*a*, 8*b* collectively define a diamond shape in plan view.

In greater detail, the low-band radiating element 51 includes four half-wave (λ/2) dipoles 3*a*, 3*b* and 4*a*, 4*b* provided in a box-dipole arrangement on the diamond-shaped PCB structure 50, where the first pair of dipoles 3*a*, 3*b* are opposite one another, and the second pair of dipoles 4*a*, 4*b* are opposite one another. The arm segments 7*a*, 7*b* and 8*a*, 8*b* of the dipoles 3*a*, 3*b* and 4*a*, 4*b* may be defined by conductive metal segments 12 on the front/top surface and/or the back/bottom surface of the PCB structure 50, where the metal segments 12 of each arm segment 7*a*, 7*b*, 8*a*, 8*b* define quarter-wave (λ/4) dipoles. The first pair of dipoles 3*a*, 3*b* may be oriented at an angle of −45° to the antenna axis 15, and the second pair of dipoles 4*a*, 4*b* may be oriented at an angle of +45° to the antenna axis 15, such that the dipole pairs 3*a*, 3*b* and 4*a*, 4*b* are configured to radiate dual slant polarizations. The metal segments 12 may define or otherwise be coupled to inductors and capacitors (5L and 5C shown in FIG. 1B), which form a series inductor-capacitor circuit on each of the arm segments 7*a*, 7*b*, 8*a*, 8*b*. The inductor-capacitor circuits define a band-stop filter configured to "cloak" a higher operating frequency range (e.g., about 1.7 GHz to about 2.7 GHz) in some embodiments.

FIG. 6 is a plan view of the front surface of a low-band radiating element 61 in accordance with embodiments of the present disclosure. In FIG. 6, the portions of the PCB structure 60 defining the arm segments 7*a*, 7*b* and 8*a*, 8*b* of the first and second pairs of dipoles 3*a*, 3*b* and 4*a*, 4*b* have respective arc shapes. As such, the arm segments 7*a*, 7*b* and 8*a*, 8*b* collectively define an elliptical shape (shown as a circular shape) in plan view.

In greater detail, the low-band radiating element 61 includes four half-wave (λ/2) dipoles 3*a*, 3*b* and 4*a*, 4*b* provided in a box-dipole arrangement on the circle-shaped PCB structure 60, where the first pair of dipoles 3*a*, 3*b* are opposite one another, and the second pair of dipoles 4*a*, 4*b* are opposite one another. The arm segments 7*a*, 7*b* and 8*a*, 8*b* of the dipoles 3*a*, 3*b* and 4*a*, 4*b* may be defined by conductive metal segments 12 on the front/top surface and/or the back/bottom surface of the PCB structure 60, where the metal segments 12 of each arm segment 7*a*, 7*b*, 8*a*, 8*b* define, quarter-wave (λ/4) dipoles. The first pair of dipoles 3*a*, 3*b* may be oriented at an angle of −45° to the antenna axis 15, and the second pair of dipoles 4*a*, 4*b* may be oriented at an angle of +45° to the antenna axis 15, such that the dipole pairs 3*a*, 3*b* and 4*a*, 4*b* are configured to radiate dual slant polarizations. The metal segments 12 may define or otherwise be coupled to inductors and capacitors (5L and 5C shown in FIG. 1B), which form a series inductor-capacitor circuit on each of the arm segments 7*a*, 7*b*, 8*a*, 8*b*. The inductor-capacitor circuits define a band-stop filter configured to "cloak" a higher operating frequency range (e.g., about 1.7 GHz to about 2.7 GHz) in some embodiments.

Figure 7:
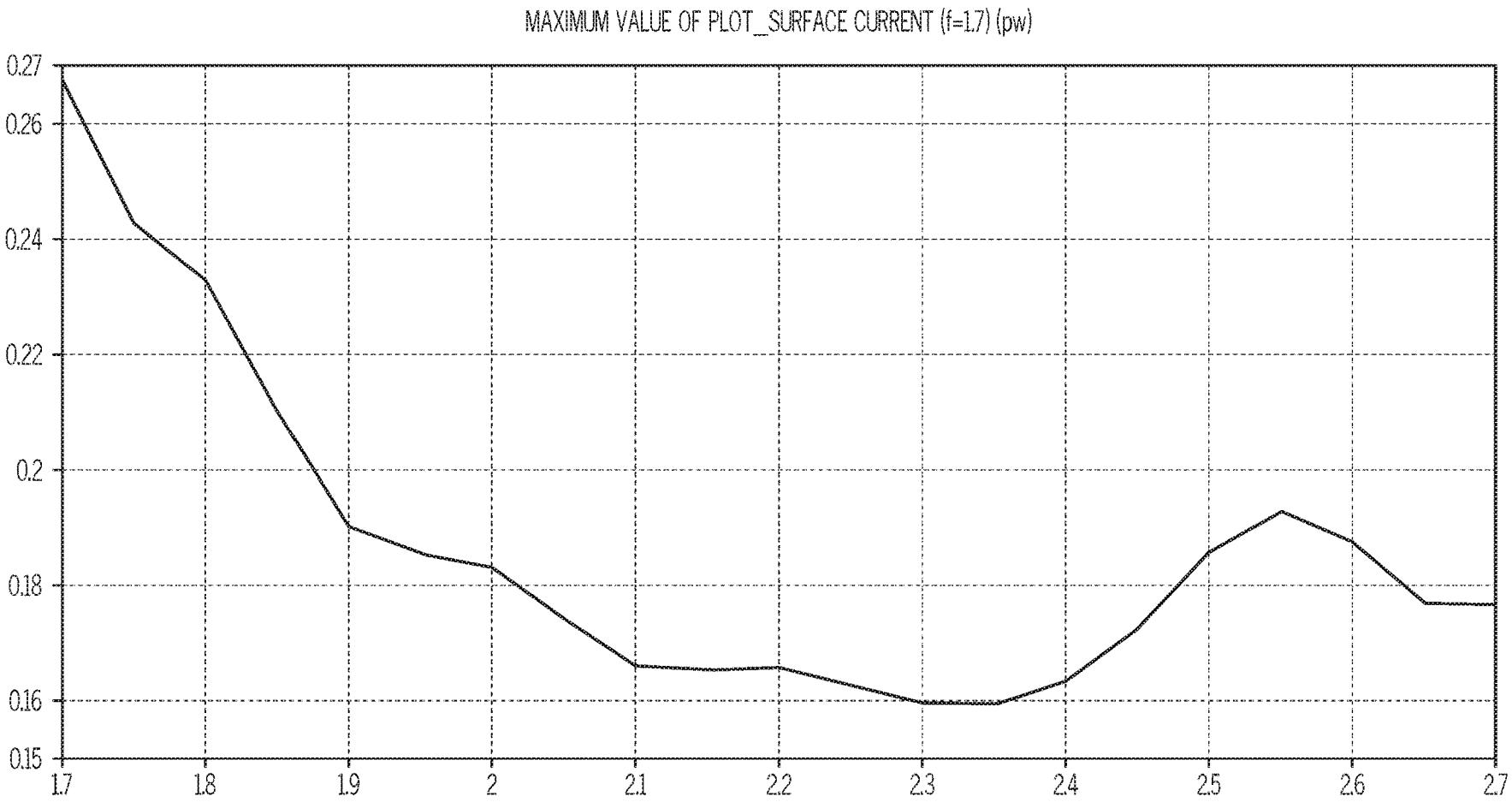
FIG. 7 is a graph illustrating cloaking effects of low-band radiating elements in accordance with embodiments of the present disclosure with respect to a high-band operating frequency range.

FIG. 7 is a graph illustrating cloaking effects of low-band dipole antennas in accordance with embodiments of the present disclosure on high-band radiation. In particular, FIG. 7 plots surface current of PCB-based box-dipole low-band radiating element elements including series inductor-capacitor circuits on the dipole arms as described herein (such as the low-band radiating elements 11, 11', 41, 51, 61) over a high-band frequency range of about 1.7 GHz to about 2.7 GHz. In some embodiments, this high-band frequency range may correspond to an operating frequency range of a high-band dipole antenna (such as the high-band radiating elements 25), which may be positioned within a perimeter defined by the arm segments of the box-dipole low-band antenna. As shown in FIG. 7, the values of the inductors and capacitors (5L and 5C shown in FIG. 1B) may be selected such that the maximum surface current of box-dipole low-band radiating element elements as described herein is relatively low over the 1.7-2.7 GHz range. Thus, box-dipole low-band radiating element as described herein may provide effective cloaking with respect to high-band radiation.

Figure 8:
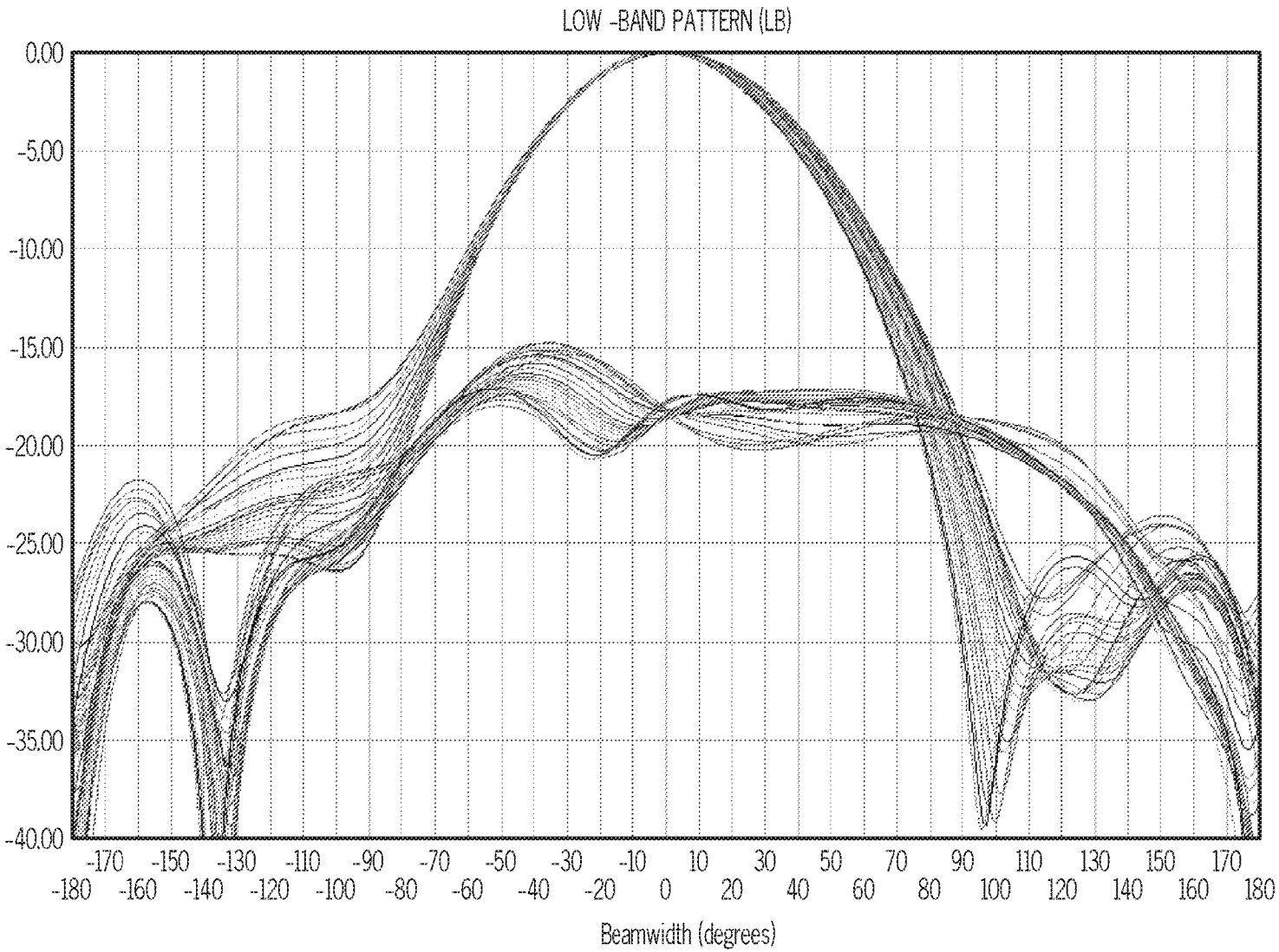
FIGS. 8 and 9 are graphs illustrating low-band and high-band radiation patterns, respectively, of radiating elements in accordance with embodiments of the present disclosure.
Figure 9:
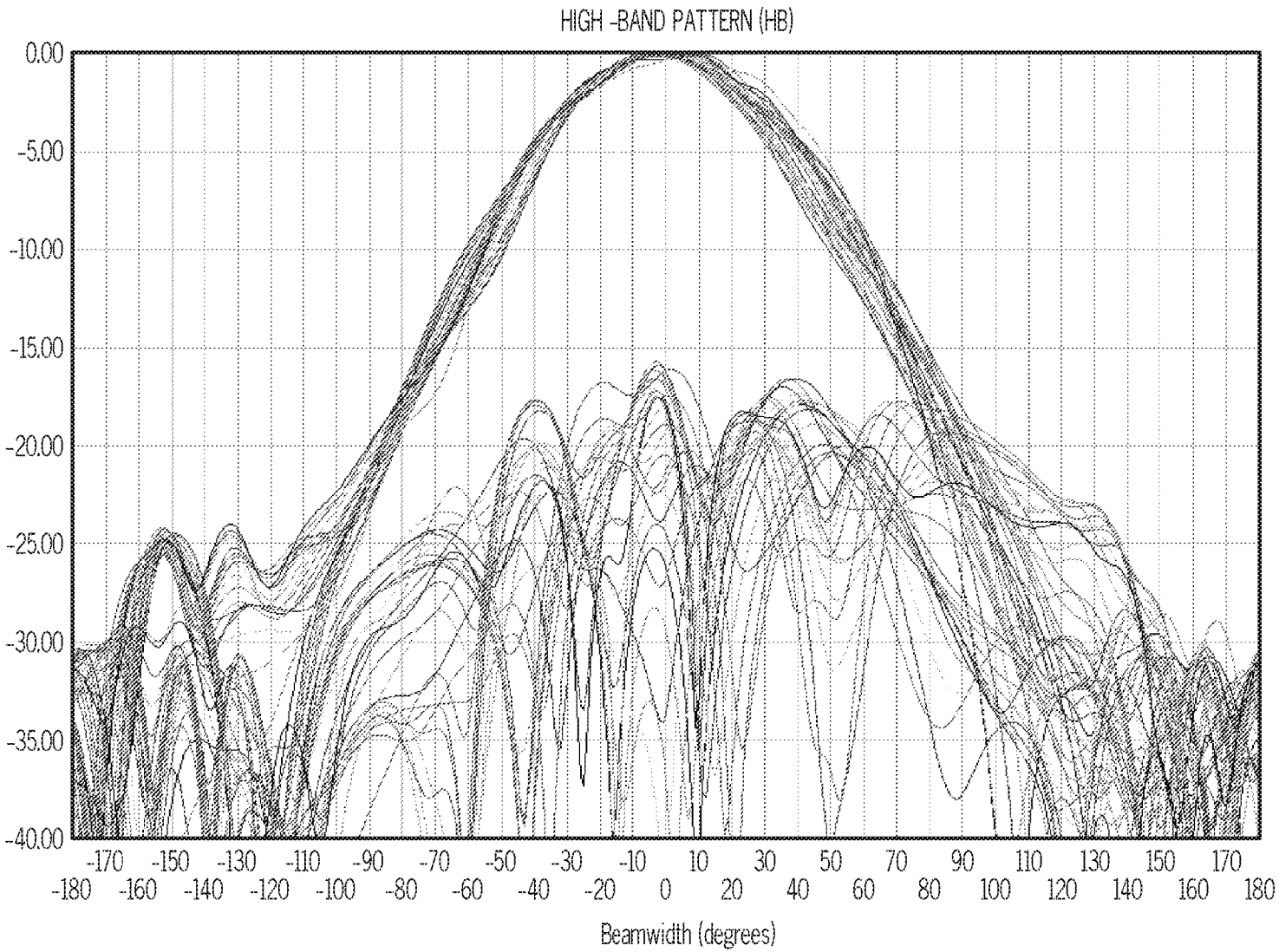

FIGS. 8 and 9 are graphs illustrating low-band and high-band radiation patterns, respectively, of radiating elements in a multi-band antenna array in accordance with embodiments of the present disclosure, such as the array 110 of FIG. 1C. More particularly, FIG. 8 illustrates azimuth beamwidth performance (in degrees) for PCB-based box-dipole low-band radiating elements including series inductor-capacitor circuits on the dipole arms as described herein, while FIG. 9 illustrates azimuth beamwidth performance (in degrees) for high-band radiating elements positioned within a perimeter defined by the arm segments of the box-dipole low-band radiating elements. In FIGS. 8 and 9, the X-axis is the azimuth angle, and Y-axis is the normalized power level over the test range. The high-band radiating elements are arranged interspersed between low-band radiating elements, which are arranged in a column. FIGS. 8 and 9 illustrate that the LB and HB azimuth patterns are relatively stable with frequency, with reduced levels of sidelobes and less tendency to flare out at wide angles, and thus, may provide acceptable performance in embodiments of the present disclosure.

Antennas as described herein can support multiple frequency bands and technology standards. For example, wireless operators can deploy using a single antenna Long Term Evolution (LTE) network for wireless communications in the 2.6 GHz and 700 MHz bands, while supporting Wideband Code Division Multiple Access (W-CDMA) network in the 2.1 GHz band. For ease of description, the antenna array is considered to be aligned vertically. Embodiments described herein can utilize dual orthogonal polarizations and support multiple-input and multiple-output (MIMO) implementations for advanced capacity solutions. Embodiments described herein can support multiple air-interface technologies using multiple frequency bands presently and in the future as new standards and bands emerge in wireless technology evolution.

Although embodiments are described herein with reference to dual-polarized antennas, the present disclosure may also be implemented in a circularly polarized antenna in which the four dipoles are driven 90° out of phase.

Although embodiments have been described herein with respect to operation in a transmit mode (in which the antennas transmit radiation) and a receive mode (in which the antennas receive radiation), the present disclosure may also be implemented in antennas which are configured to operate only in a transmit mode or only in a receive mode.

Embodiments of the present disclosure have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" or "front" or "back" or "top" or "bottom" may be used herein to describe a relationship of one element, layer or region to another element, layer or region as illustrated in the figures. It will be understood that these terms are intended to encompass different orientations of the device in addition to the orientation depicted in the figures.

Unless otherwise defined, all technical and scientific terms used herein have the same meaning as commonly understood by one of ordinary skill in the art to which this invention belongs. The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Aspects and elements of all of the embodiments disclosed above can be combined in any way and/or combination with aspects or elements of other embodiments to provide a plurality of additional embodiments.

In the drawings and specification, there have been disclosed typical embodiments of the invention and, although specific terms are employed, they are used in a generic and descriptive sense only and not for purposes of limitation, the scope of the invention being set forth in the following claims.

That which is claimed:

1. A dipole antenna comprising:

a planar reflector; and a radiating element comprising first and second pairs of dipoles on a surface of the planar reflector, the first and second pairs of dipoles respectively comprising arm segments arranged around a central region in a box dipole arrangement, wherein the arm segments comprise respective metal segments and respective inductor-capacitor circuits, and wherein the inductor-capacitor circuits define a filter aligned to a frequency range higher than an operating frequency range of the first and second pairs of dipoles, wherein the arm segments of the first pair of dipoles are capacitively coupled to the arm segments of the second pair of dipoles adjacent thereto by respective coupling regions therebetween, and wherein the respective inductor-capacitor circuits are distinct from the respective coupling regions.

2. The dipole antenna of claim 1, wherein the arm segments comprise printed circuit board portions having the respective metal segments and the respective inductor-capacitor circuits thereon.

3. A dipole antenna comprising:

a planar reflector; and a radiating element comprising first and second pairs of dipoles on a surface of the planar reflector, the first and second pairs of dipoles respectively comprising arm segments arranged around a central region in a box dipole arrangement, wherein the arm segments comprise printed circuit board portions having respective metal segments and respective inductor-capacitor circuits thereon.

4. The dipole antenna of claim 3, wherein the first and second pairs of dipoles define a low-band dipole antenna, and further comprising:

a high-band dipole antenna arranged within a perimeter defined by the arm segments of the low-band dipole antenna, the high-band dipole antenna having an operating frequency range that comprises a frequency range of a filter defined by the respective inductor-capacitor circuits.

5. The dipole antenna of claim 3, wherein the arm segments of the first pair of dipoles are capacitively coupled to the arm segments of the second pair of dipoles adjacent thereto by respective coupling regions therebetween.

6. The dipole antenna of claim 5, wherein the respective coupling regions are defined by overlapping portions of the respective metal segments on opposite sides of the printed circuit board portions.

7. The dipole antenna of claim 5, wherein the respective coupling regions are defined by portions of the respective metal segments that extend toward the planar reflector at edges of adjacent ones of the arm segments.

8. The dipole antenna of claim 5, wherein the respective coupling regions are defined by plated through-hole vias.

9. The dipole antenna of claim 5, wherein the respective coupling regions are defined by portions of the respective metal segments comprising interdigitated fingers at edges of adjacent ones of the arm segments.

10. The dipole antenna of claim 3, wherein the arm segments of the first and second pairs of dipoles collectively define an octagonal shape in plan view.

11. The dipole antenna of claim 3, wherein the arm segments of the first and second pairs of dipoles are substantially linear such that the arm segments collectively define a rectangular shape in plan view.

12. The dipole antenna of claim 3, wherein the arm segments of the first and second pairs of dipoles are bent at respective angles such that the arm segments collectively define a diamond shape in plan view.

13. The dipole antenna of claim 3, wherein the arm segments of the first and second pairs of dipoles define respective arc shapes such that the arm segments collectively define an elliptical shape in plan view.

14. The dipole antenna of claim 3, further comprising:

first and second pairs of feed stalks extending from the planar reflector towards the first and second pairs of dipoles, respectively, wherein the printed circuit board portions of the first and second pairs of dipoles comprise respective slots therein that are adapted to mate with respective tabs of the first and second pairs of feed stalks, respectively.

15. The dipole antenna of claim 14, wherein the first and second pairs of feed stalks respectively comprise:

a support printed circuit board extending from the planar reflector to support one of the arm segments of a respective one of the first and second pairs of dipoles;

a feed line which extends on the support printed circuit board from the planar reflector towards the respective one of the first and second pairs of dipoles; and a balun which extends on the support printed circuit board and is connected to the feed line at an end thereof proximate the respective one of the first and second pairs of dipoles.

16. A multi-band antenna, comprising:

a planar reflector;

a first radiating element on a surface of the planar reflector, the first radiating element having a first operating frequency range, the first radiating element comprising first and second pairs of dipoles respectively comprising arm segments arranged around a central region in a box dipole arrangement, wherein the arm segments comprise respective metal segments and respective inductor-capacitor circuits, and wherein the inductor-capacitor circuits define a filter aligned to a frequency range; and a second radiating element on the surface of the planar reflector and arranged within a perimeter defined by the arm segments of the first radiating element, the second radiating element comprising third and fourth pairs of dipoles and having a second operating frequency range that is higher than the first operating frequency range and comprises the frequency range of the filter, wherein the arm segments of the first pair of dipoles are capacitively coupled to the arm segments of the second pair of dipoles adjacent thereto by respective coupling regions therebetween, and wherein the respective inductor-capacitor circuits are distinct from the respective coupling regions.

17. A multi-band antenna, comprising:

a planar reflector;

a first radiating element on a surface of the planar reflector, the first radiating element having a first operating frequency range, the first radiating element comprising first and second pairs of dipoles respectively comprising arm segments arranged around a central region in a box dipole arrangement, wherein the arm segments comprise respective metal segments and respective inductor-capacitor circuits, and wherein the inductor-capacitor circuits define a filter aligned to a frequency range; and a second radiating element on the surface of the planar reflector and arranged within a perimeter defined by the arm segments of the first radiating element, the second radiating element comprising third and fourth pairs of dipoles and having a second operating frequency range that is higher than the first operating frequency range and comprises the frequency range of the filter, wherein the arm segments comprise printed circuit board portions having the respective metal segments and the respective inductor-capacitor circuits thereon.

18. The multi-band antenna of claim 17, wherein the arm segments of the first pair of dipoles are capacitively coupled to the arm segments of the second pair of dipoles adjacent thereto by respective coupling regions therebetween.

19. The multi-band antenna of claim 18, wherein the respective coupling regions are defined by overlapping portions of the respective metal segments on opposite sides of the printed circuit board portions.

20. The multi-band antenna of claim 18, wherein the respective coupling regions are defined by portions of the respective metal segments that extend toward the planar reflector at edges of adjacent ones of the arm segments.

21. The multi-band antenna of claim 18, wherein the respective coupling regions are defined by plated through-hole vias.

22. The multi-band antenna of claim 18, wherein the respective coupling regions are defined by portions of the respective metal segments comprising interdigitated fingers at edges of adjacent ones of the arm segments.

23. The multi-band antenna of claim 17, wherein the arm segments of the first and second pairs of dipoles comprise:

segments that are bent at respective angles such that the arm segments collectively define an octagonal shape or a diamond shape in plan view;

segments that are substantially linear such that the arm segments collectively define a rectangular shape in plan view; or segments comprising respective arc shapes such that the arm segments collectively define an elliptical shape in plan view.

24. The multi-band antenna of claim 17, further comprising:

first and second pairs of feed stalks extending from the planar reflector towards the first and second pairs of dipoles, respectively, wherein the printed circuit board portions of the first and second pairs of dipoles comprise respective slots therein that are adapted to mate with respective tabs of the first and second pairs of feed stalks, respectively.

* * * * *